US007553187B2

(12) United States Patent
Feldman et al.

(10) Patent No.: US 7,553,187 B2
(45) Date of Patent: Jun. 30, 2009

(54) ELECTRICAL CONNECTOR ASSEMBLY

(75) Inventors: Steven Feldman, Cedar Park, TX (US); Kevin R. Meredith, Loretto, KY (US); Rudy L. Densmore, Austin, TX (US); Joseph N. Castiglione, Cedar Park, TX (US); Alexander R. Mathews, Austin, TX (US); Alexander W. Barr, Austin, TX (US); Richard J. Scherer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 51 days.

(21) Appl. No.: 11/627,258

(22) Filed: Jan. 25, 2007

(65) Prior Publication Data

US 2007/0197095 A1 Aug. 23, 2007

Related U.S. Application Data

(60) Provisional application No. 60/763,733, filed on Jan. 31, 2006, provisional application No. 60/824,332, filed on Sep. 1, 2006.

(51) Int. Cl.
*H01R 13/648* (2006.01)

(52) U.S. Cl. ..... 439/607; 439/108

(58) Field of Classification Search ..... 439/620.27, 439/608, 108

See application file for complete search history.

(56) References Cited

U.S. PATENT DOCUMENTS 2,920,782 A * 1/1960 Otto ..... 217/32
3,203,612 A * 8/1965 Schaefer ..... 229/120.36
3,820,679 A * 6/1974 Schweitzer ..... 229/120.36
3,942,709 A * 3/1976 Gepfer ..... 229/120.36
4,000,845 A * 1/1977 Zeller ..... 229/120.36
5,046,960 A 9/1991 Fedder
5,116,230 A 5/1992 Dechelette et al.
5,184,965 A 2/1993 Myschik et al.
5,194,020 A * 3/1993 Voltz ..... 439/579
5,222,898 A 6/1993 Fedder et al.
5,785,239 A * 7/1998 Campbell et al. ..... 229/120.36
5,938,476 A 8/1999 Wu et al.
5,964,621 A 10/1999 Wolla et al.
6,146,202 A * 11/2000 Ramey et al. ..... 439/608
6,203,369 B1 3/2001 Feldman
6,231,391 B1 5/2001 Ramey et al.
6,257,931 B1 7/2001 Sakurai et al.
6,368,120 B1 4/2002 Scherer et al.
6,371,813 B2 4/2002 Ramey et al.

(Continued)

FOREIGN PATENT DOCUMENTS

DE 41 16 166 5/1991

(Continued)

*Primary Examiner*—Tho D Ta
*Assistant Examiner*—Travis Chambers
(74) *Attorney, Agent, or Firm*—Johannes P. M. Kusters

(57) ABSTRACT

An electrical connector assembly includes an organizer plate having a plurality apertures for receiving termination devices. Each termination device includes a shield box, an insulator, and a socket contact. The shield box has at least one outwardly extending ground contact element and a latch member. When the termination device is inserted into an aperture of the organizer plate, the latch member on the shield box engages a surface of the organizer plate to prevent withdrawal of the termination device.

15 Claims, 27 Drawing Sheets

U.S. PATENT DOCUMENTS

| | | | | |
|---|---|---|---|---|
| 6,524,135 | B1 | 2/2003 | Feldman et al. | |
| 6,533,609 | B2 | 3/2003 | Koide | |
| 6,684,591 | B2 * | 2/2004 | Jean | 52/589.1 |
| 6,688,920 | B2 | 2/2004 | Lehner et al. | |
| 6,743,050 | B1 | 6/2004 | Wu | |
| 6,780,069 | B2 | 8/2004 | Scherer et al. | |
| 6,830,480 | B2 | 12/2004 | Yoshioka | |
| 6,971,916 | B2 * | 12/2005 | Tokunaga | 439/608 |
| 7,044,793 | B2 | 5/2006 | Takemasa | |

FOREIGN PATENT DOCUMENTS

| | | | |
|---|---|---|---|
| EP | 0 570 181 | A2 | 11/1993 |
| JP | 8096864 | A | 4/1996 |
| JP | 11074037 | A | 3/1999 |
| JP | 2000040563 | | 2/2000 |
| JP | 2000-067980 | | 3/2000 |
| JP | 2002319458 | A | 10/2002 |

* cited by examiner

ELECTRICAL CONNECTOR ASSEMBLY

CROSS REFERENCE To RELATED APPLICATIONS

This application claims the benefit of U.S. Provisional Patent Application No. 60/763,733, filed Jan. 31, 2006 and 60/824,332, filed Sep. 1, 2006, the disclosures of which are incorporated by reference herein in its entirety.

FIELD

The present disclosure relates to high speed electrical connectors. In particular, the present invention relates to electrical connectors that provide high signal line density while also providing shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as signal transmission times) have been slow when compared to the length of time required for a signal to propagate through a conductor in the interconnect or in the printed circuit board. As user requirements grow more demanding with respect to both interconnect sizes and signal transmission times, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

One aspect of the invention described herein provides an electrical connector assembly. In one embodiment according to the invention, the electrical connector assembly comprises an organizer plate having a plurality apertures extending therethrough, and a plurality of termination devices. Each termination device comprises an electrically conductive outer shield box having a front end and a back end. The shield box has at least one outwardly extending ground contact element disposed on a side surface thereof, and a latch member extending therefrom. An insulator is disposed within the shield box. A socket contact is supported within and electrically isolated from the shield box by the insulator. The socket contact is configured for making electrical connections through the front end and back end of the shield box. When the individual termination devices are inserted into the apertures of the organizer plate, the latch member engages a surface of the organizer plate to prevent withdrawal of the termination device.

Another aspect of the invention described herein provides an organizer for use in an electrical connector assembly. In one embodiment according to the invention, the organizer comprises a plurality of planar row organizer plates and a plurality of planar column organizer plates. The plurality of planar column organizer plates are transversely positioned with respect to the plurality of row organizer plates. Each row organizer plate defines a top edge and a bottom edge, a plurality of first slots extending from the top edge toward the bottom edge, and a plurality of alignment arms extending from the top edge away from the bottom edge. Each column organizer plate defines a top edge and a bottom edge, a plurality of second slots extending from the bottom edge toward the top edge, and a plurality of registration channels extending from the top edge toward the bottom edge. The first slots of the row organizer plates interlock with the second slots of the column organizer plates, and the alignment arms of the row organizer plates are retained by the registration channels of the column organizer plates.

Another aspect of the invention described herein provides an electrical connector. In one embodiment according to the invention, the electrical connector comprises: an electrical cable including a central conductor and ground shield surrounding the central conductor; a socket contact connected to the central conductor; an insulative member disposed around the socket contact; an electrically conductive shield box disposed around the insulative member and spaced from the ground shield; and a solderable collar disposed between the ground shield and the conductive shield box. The collar is configured to defined a first solder gap between the collar and the shield box and a second solder gap between the collar and the ground shield.

BRIEF DESCRIPTION OF THE DRAWINGS

The present invention will be further described with reference to the accompanying drawings wherein like reference numerals refer to like parts in the several views, and wherein.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
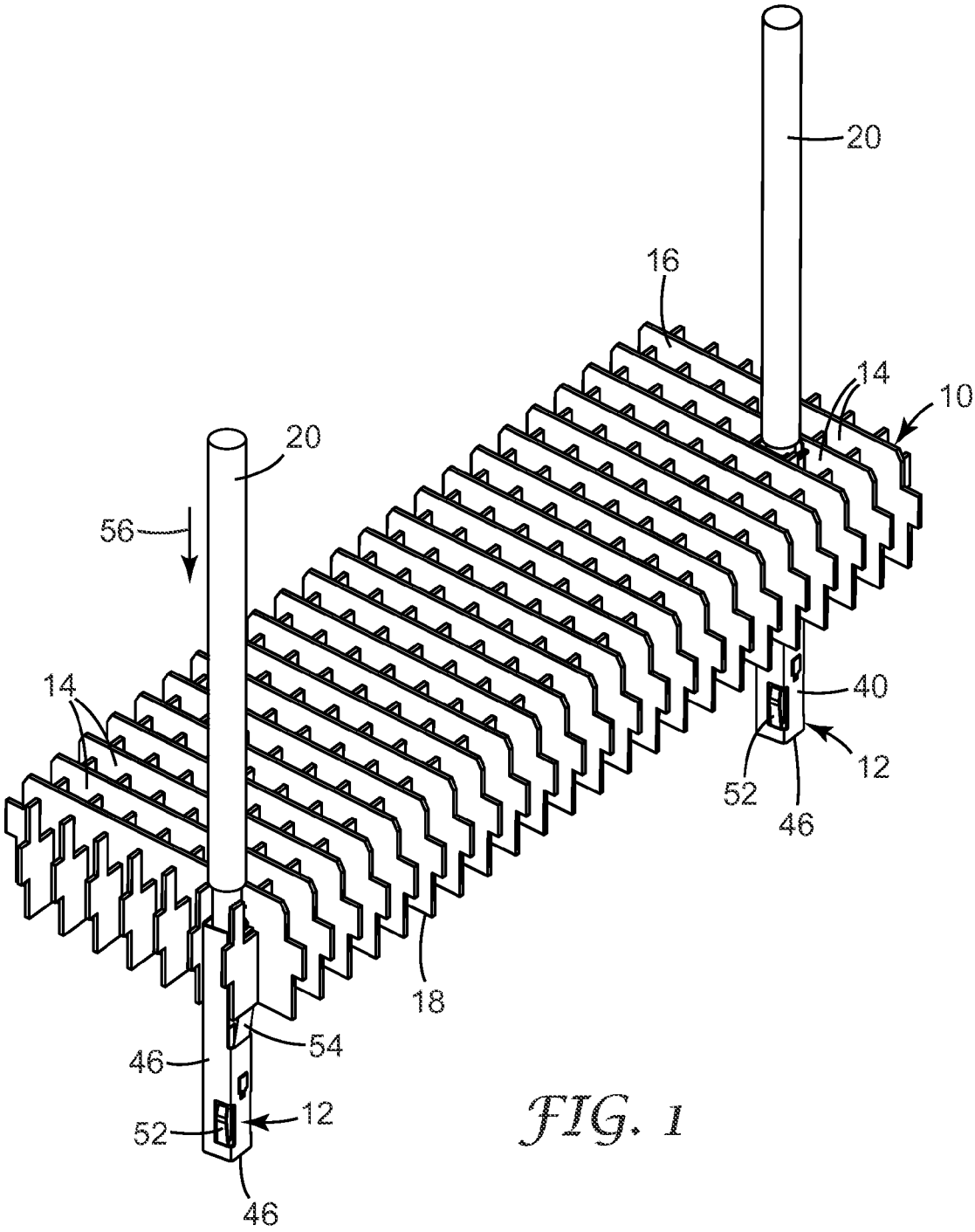
FIG. 1 is a perspective illustration of an organizer plate for receiving termination devices according to one embodiment of the invention.

Referring now to FIG. 1, there is shown a retainer or organizer plate 10 configured to receive, secure and manage a plurality of termination devices 12. The organizer plate 10 includes a plurality of apertures 14 extending from a first side 16 to a second side 18 of the organizer plate 10. For clarity of illustration, only two termination devices 12 (terminating electrical cables 20) are shown in FIG. 1, although the organizer plate 10 is intended to accommodate a termination device 12 in each aperture 14.

Figure 2:
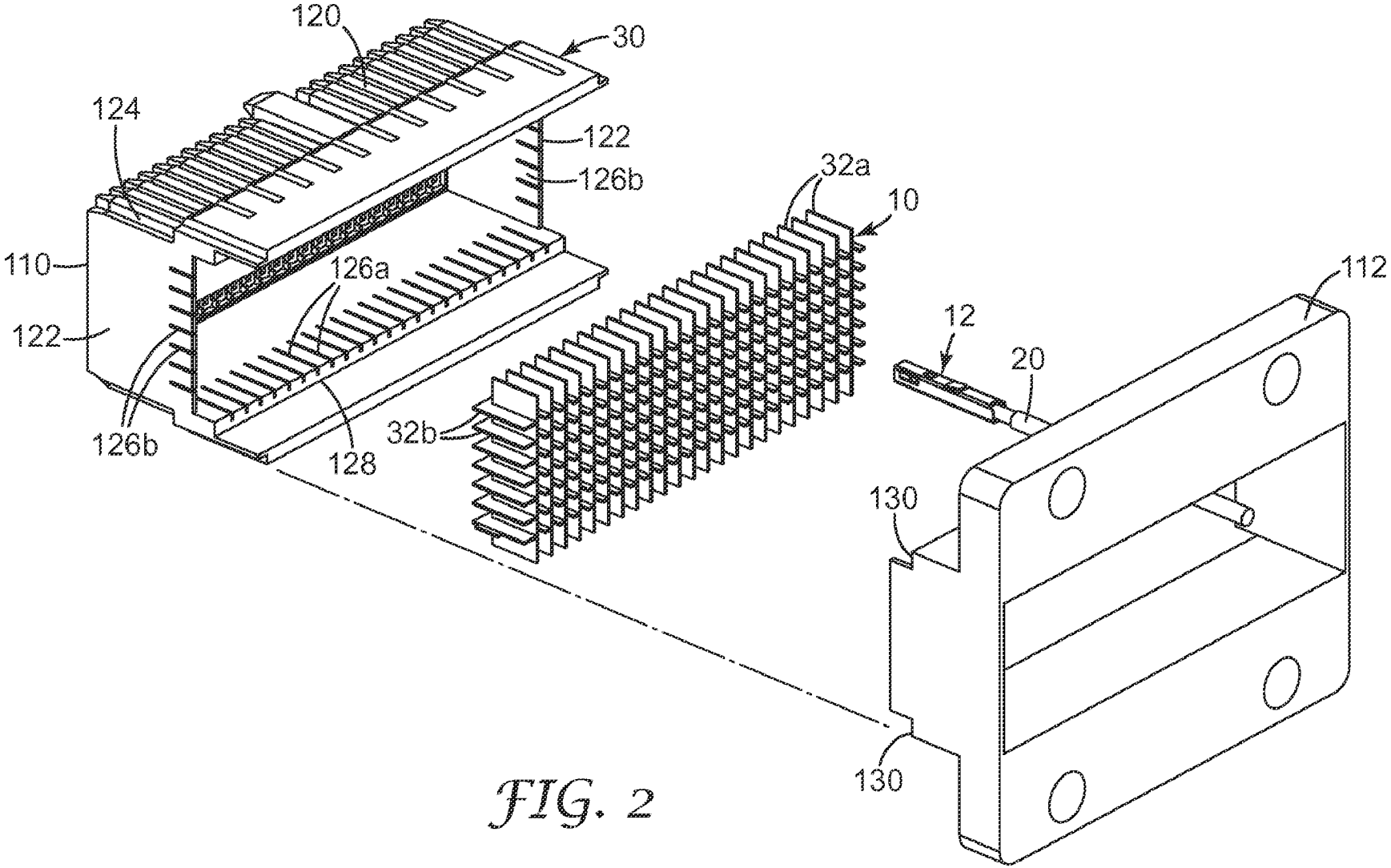
FIG. 2 is a perspective view of the organizer plate and termination devices of FIG. 1 positioned for insertion into one embodiment of an adapter.
Figure 3:
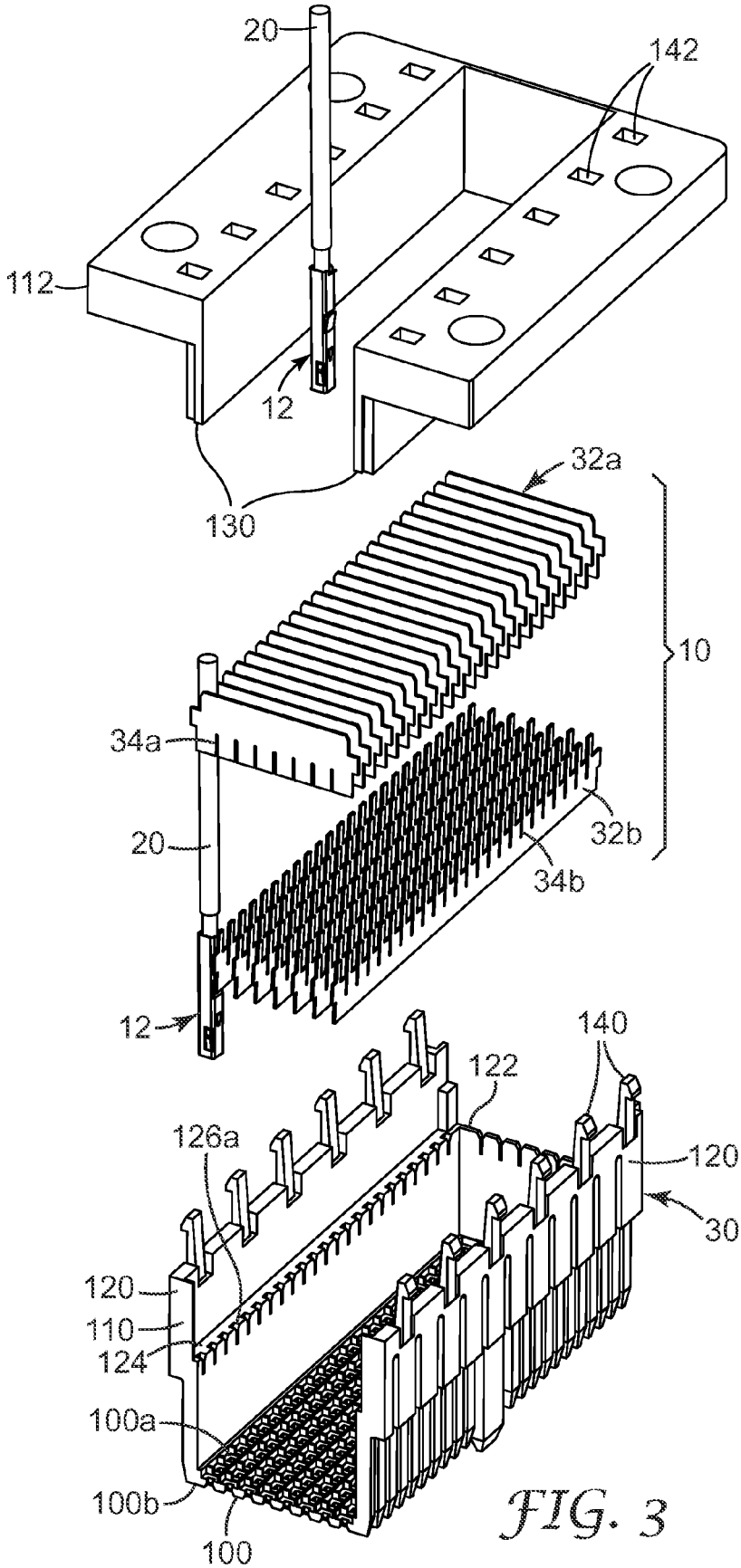
FIG. 3 is a perspective view showing the organizer plate of FIG. 1 in an exploded condition, positioned for insertion into another embodiment of an adapter.

As best seen in FIGS. 2 and 3, a carrier or adaptor 30 is configured to receive the organizer plate 10, and functions to adapt the organizer plate 10 to a particular application or use of organizer plate 10. In the embodiment illustrated herein, the adapter 30 is configured to allow the termination devices 12 in the organizer plate 10 to be mated with a pin header (not shown in FIG. 1)

Figure 4:
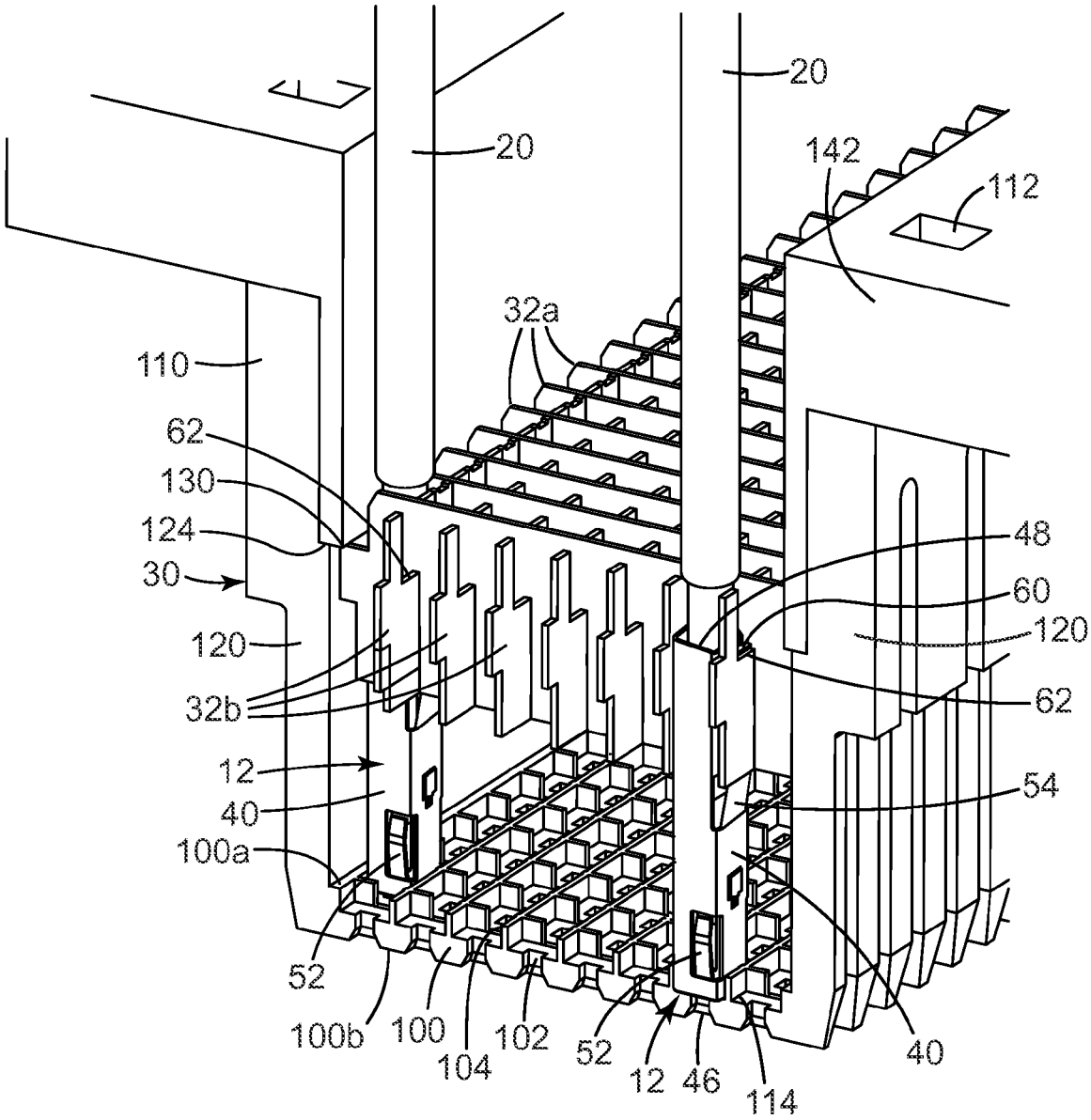
FIG. 4 is a partial cross-sectional view of the organizer plate, termination devices and adapter of FIG. 3 in an assembled condition.
Figure 5A:
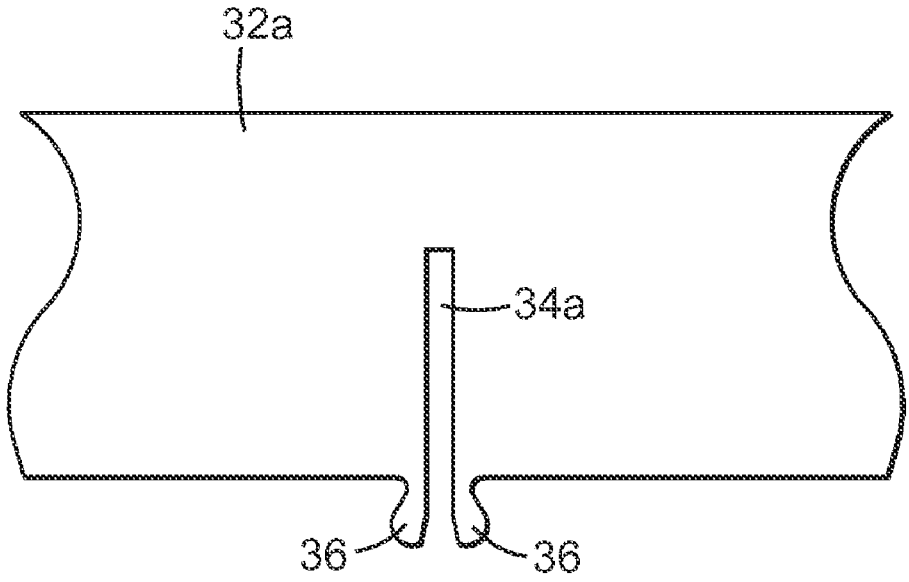
FIGS. 5A and 5B schematically illustrate one method of securing the individual plates forming the organizer plate of FIG. 1.
Figure 5B:
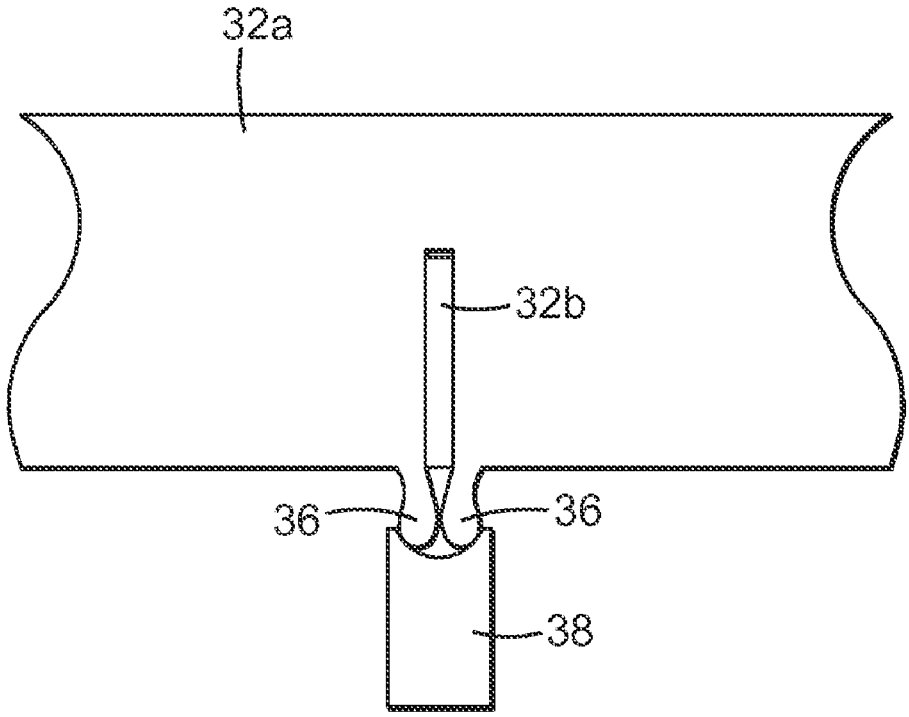

In the illustrated embodiment, and as best seen in FIGS. 3 and 4, organizer plate 10 is formed of a plurality of transversely positioned and interconnected metal plates 32*a*, 32*b* (collectively plates 32) having interlocking slots 34*a*, 34*b* (collectively slots 34), respectively, such that when assembled the plurality of metal plates 32*a*, 32*b* define the plurality of apertures 14. Referring to FIGS. 5A-5B, in one embodiment at least one of the interconnected metal plates 32*a*, 32*b* at each intersection includes a pair of protrusions 36 extending from either side of the slot 34*a* or 34*b*. After the metal plates 32*a*, 32*b* are interconnected, the protrusions 36 are deformed (as with a tool 38) to close the open end of the slot 34 and thereby permanently interlock the metal plates 32*a*, 32*b*. In other embodiments according to the invention, organizer plate 10 is formed by other means, including molding and/or machining of polymeric material, molding and/or machining of metal, or construction of a metal frame overmolded with a polymeric material.

Figure 6:
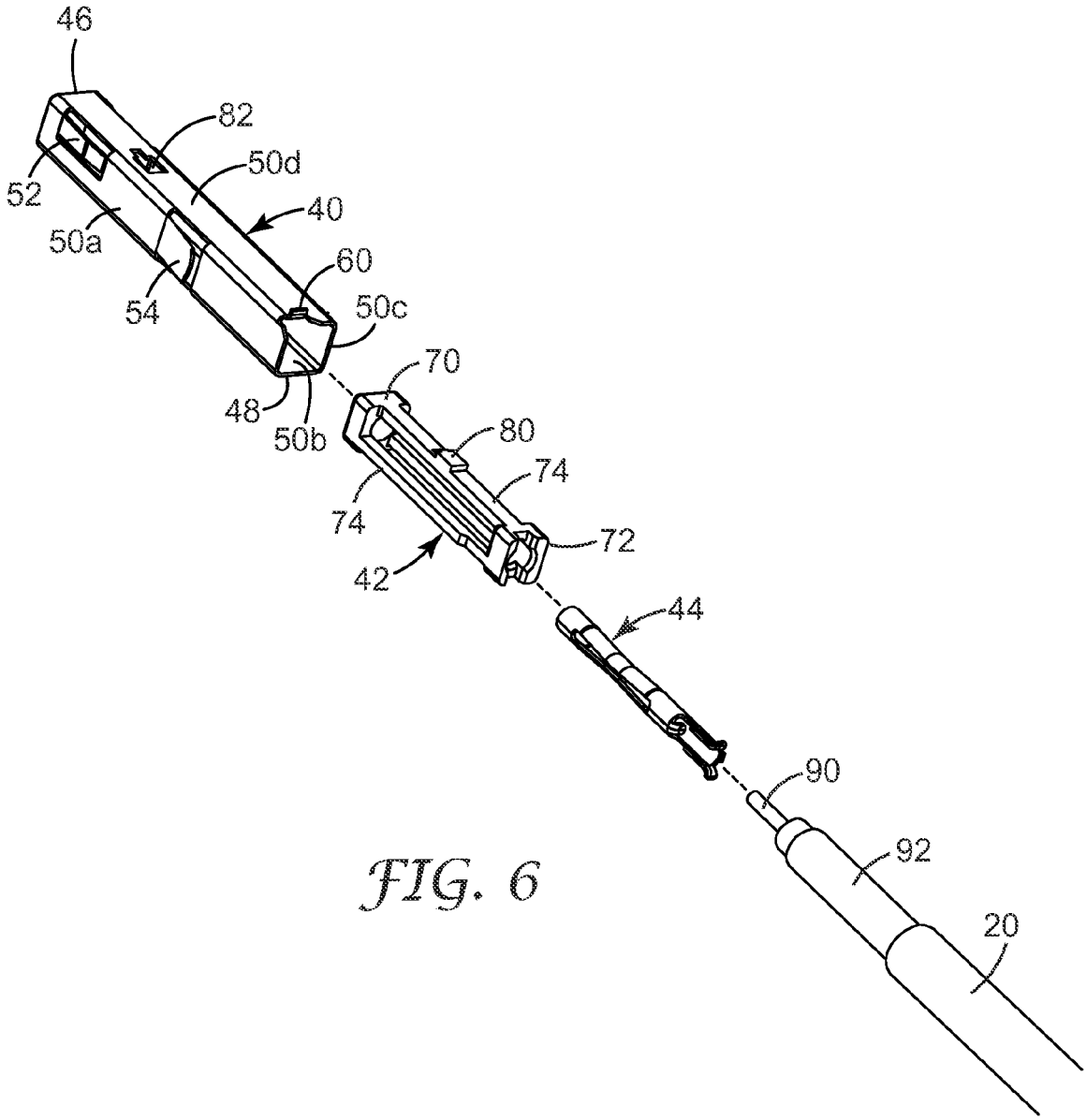
FIG. 6 is a perspective illustration of a termination device of FIG. 1 in an exploded condition.

Referring now to FIGS. 6-9, an exemplary embodiment of a termination device 12 that can be used with the organizer plate 10 is illustrated. FIG. 6 shows an exploded view of the exemplary termination device 12 used with an electrical cable 20, while FIGS. 7-9 provide detailed views of the individual components of the termination device 12. The termination device 12 includes a longitudinal electrically conductive shield box 40, an insulator 42, and a single socket contact 44.

Figure 7D:
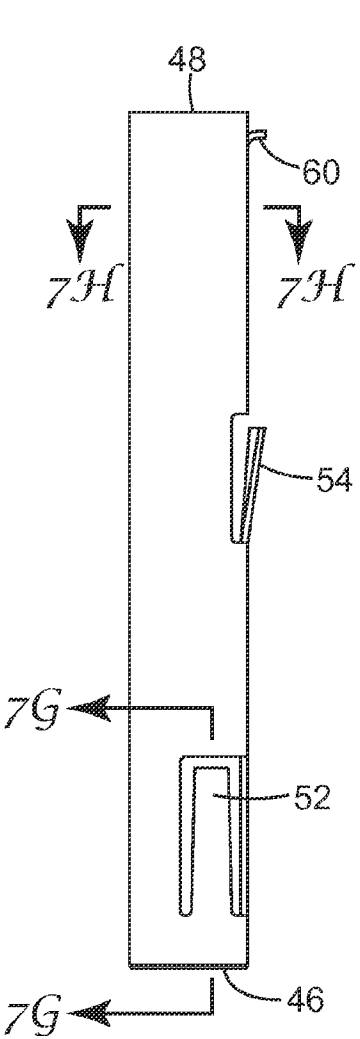
FIGS. 7A-7I are plan and cross-sectional views of the box shield of termination device of FIG. 6.
Figure 7C:
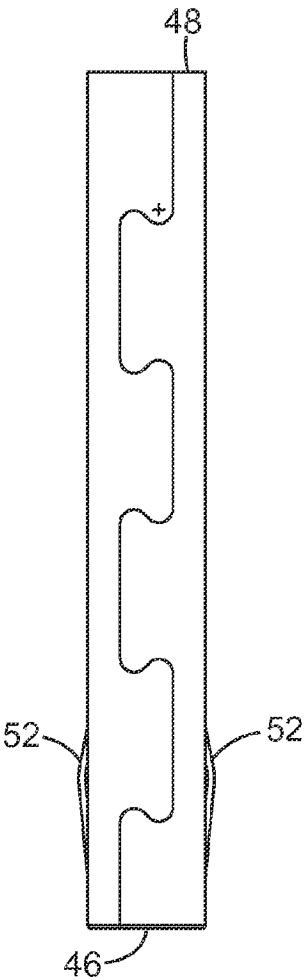
Figure 7B:
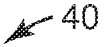
Figure 7B:
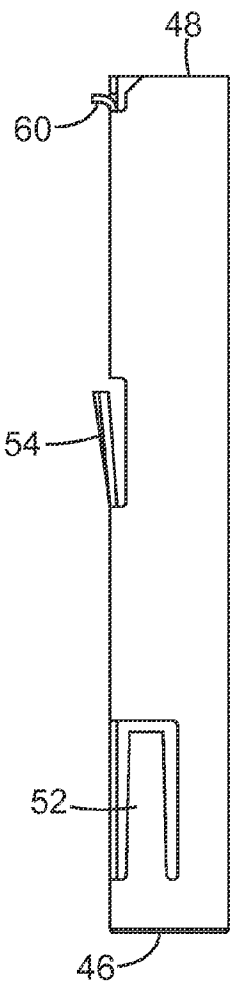
Figure 7A:
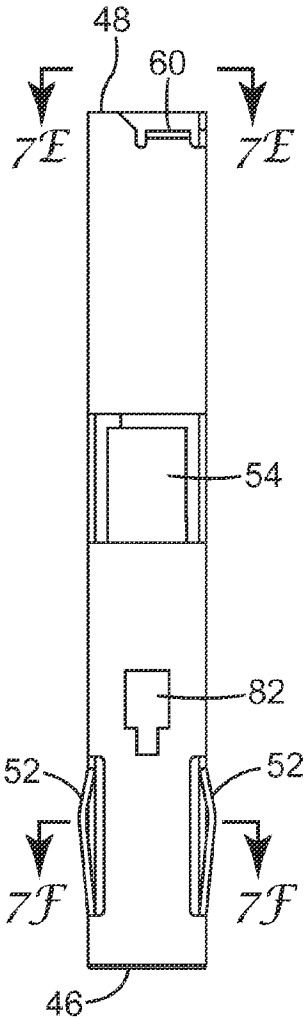
Figure 7G:
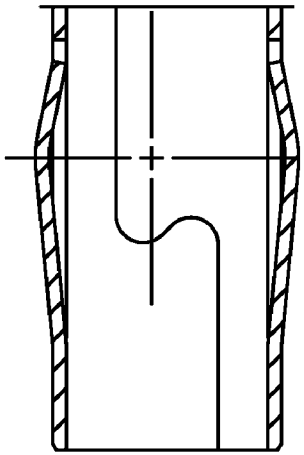
Figure 7F:
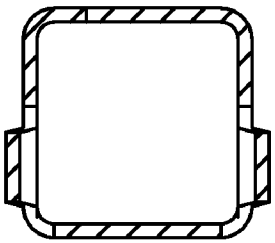
Figure 7E:
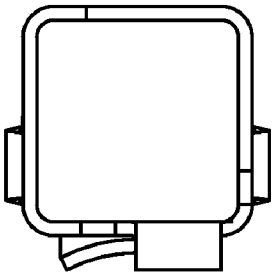
Figure 7I:
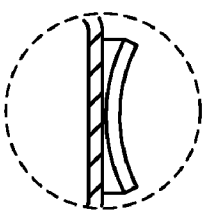
Figure 7H:
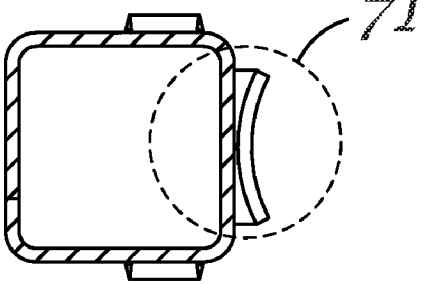
Figure 8D:
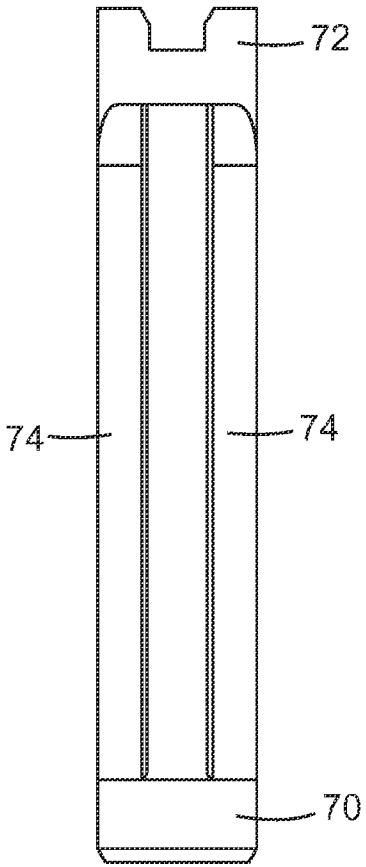
FIGS. 8A-8I are plan and cross-sectional views of the insulator in the termination device of FIG. 6.
Figure 8C:
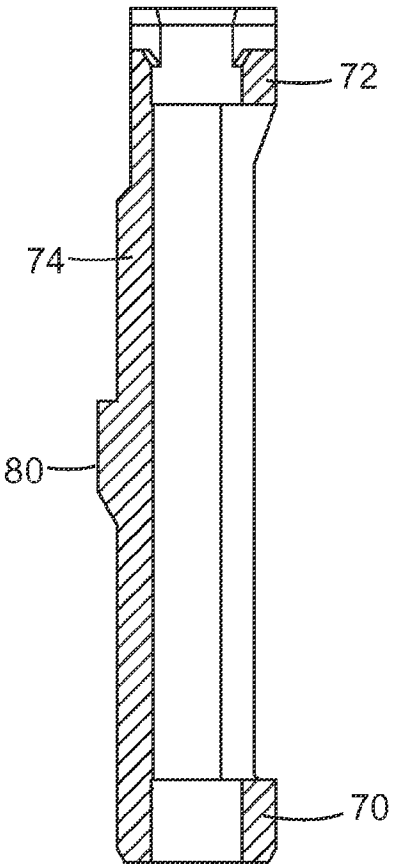
Figure 8B:
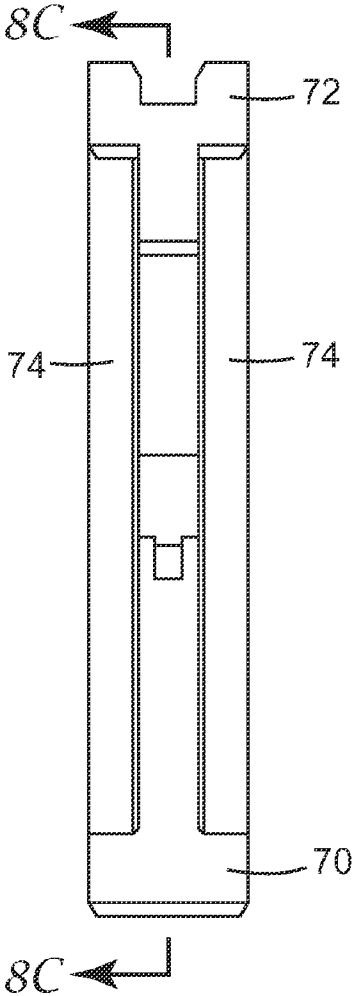
Figure 8A:
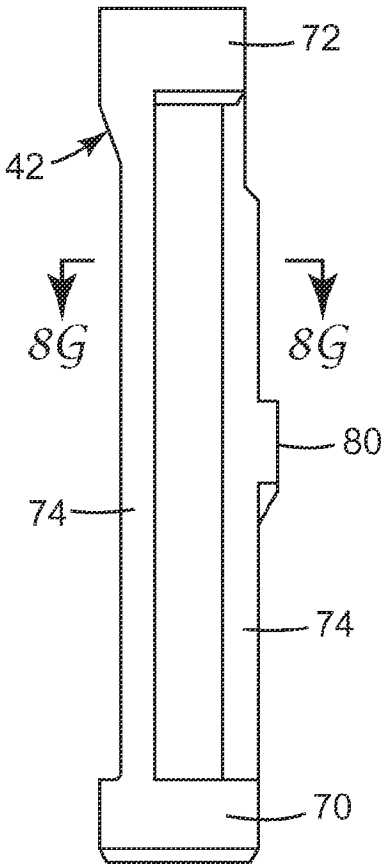
Figure 8F:
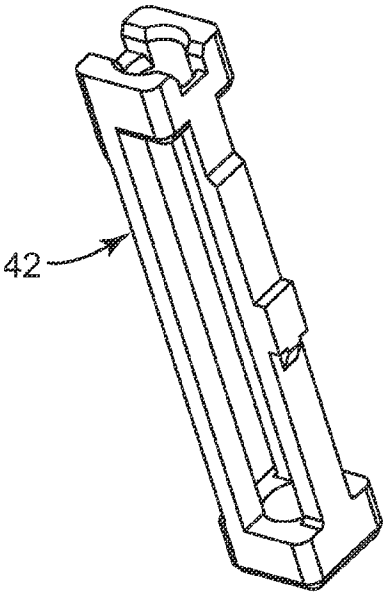
Figure 8E:
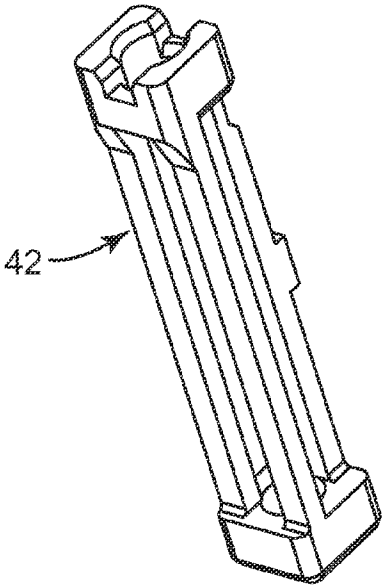
Figure 8I:
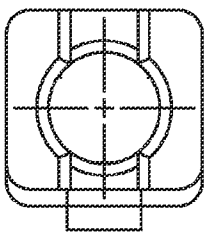
Figure 8H:
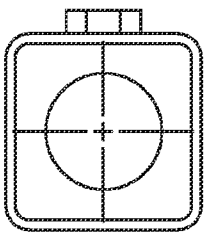
Figure 8G:
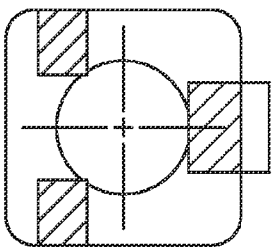
Figure 9A:
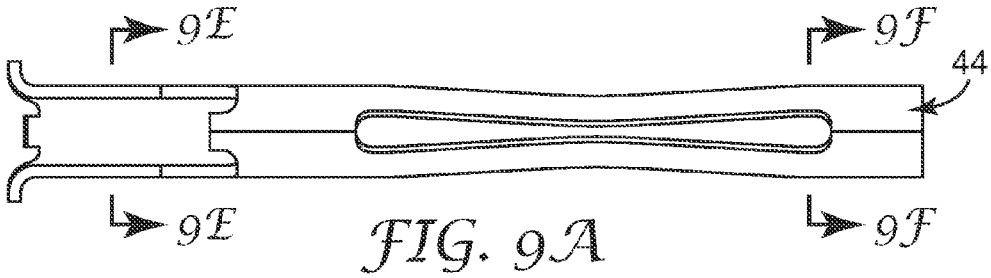
FIGS. 9A-9F are plan and cross-sectional views of the socket contact of the termination device of FIG. 6.
Figure 9B:
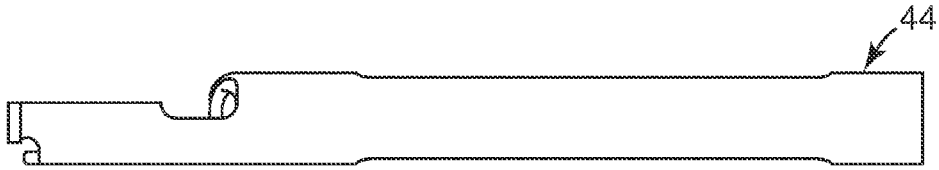
Figure 9C:
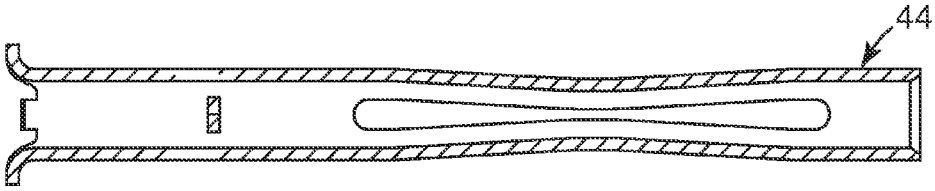
Figure 9D:
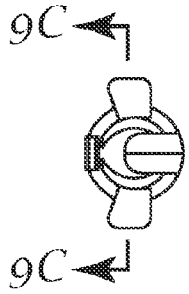
Figure 9E:
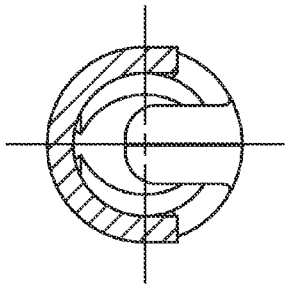
Figure 9F:
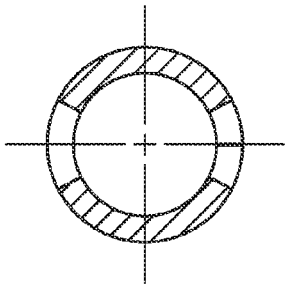

Referring to FIG. 5, 6, and 7A-7I, the conductive shield box 40 has a front end 46, a back end 48, and side surfaces 50*a*-50*d* (collectively referred to herein as "sides 50") defining a non-circular transverse cross section. Although the illustrated embodiment includes four sides 50 defining a substantially square transverse cross-section, shield box 40 can have other numbers of sides defining other non-circular transverse cross-sections. As illustrated, shield box 40 includes laterally protruding resilient ground contact beams 52 disposed on opposed side surfaces 50*a* and 50*c*. In other embodiments, shield box 40 includes only a single ground contact beam 52. A latch member 54 extends from at least one of sides 50. When termination device 12 is inserted into an aperture 14 of organizer plate 10 in the direction of arrow 56 (FIG. 1), latch member 54 is resiliently deflected inwardly (toward the interior of shield box 40) until clearing second side 18 of the organizer plate 10, at which time the latch member 54 returns to its original position to engage the second side 18 of organizer plate 10 and resist pull-out of the termination device 12 (best seen in FIG. 4). In one embodiment, latch member 54 is designed to yield (i.e., deform) at a lower force than required to break the attached cable 20, so that a termination device 12 can be pulled out of its associated aperture 14 for the purpose of replacing an individual cable assembly 20. In the illustrated embodiment of FIG. 6, the latch member 54 is shown on a same side 50*a* as one of the ground contact beams 52. However, in other embodiments, the latch member 54 is positioned on a side 50 of the shield box 40 that does not include a ground contact beam 52 (FIG. 7A). Shield box 40 further includes a keying member, in the form of tab 60, laterally extending from back end 48 of the shield box 40. When termination device 12 is inserted into organizer plate 10 in the direction of arrow 56, the tab 60 fits into a recess 62 adjacent each aperture 14 of organizer plate 10 (FIG. 4) to ensure the termination device 12 is inserted into the organizer plate 10 in the correct predetermined orientation. If termination device 12 is not properly oriented within the organizer plate aperture 14, the termination device 12 cannot be fully inserted, such that latch member 54 cannot engage second side 18 of the organizer plate. In one embodiment, tab 60 is deformable (such as by the use of a tool or the application of excess force in the insertion direction of arrow a) and may be straightened to allow a damaged or defective termination device 12 to be pushed completely through the organizer plate 10, such that the damaged or defective components can be replaced or repaired. Although the figures show that shield box 40 includes ground contact beams 52, it is within the scope of the present invention to use other contact element configurations, such as Hertzian bumps, in place of the contact beams 52.

Referring now to FIGS. 6 and 8A-8I, insulator 42 includes a first insulative member 70 disposed within the shield box 40 adjacent the front end 46, and a second insulative member 72 disposed within the shield box 40 adjacent the back end 48. In one embodiment, the first and second insulative members 70, 72 are properly positioned and spaced with respect to each other by one or more insulative spacer bars 74. In the illustrated embodiment, three spacer bars 74 are provided. The first and second insulative members 70, 72 and spacer bars 74 are shaped to receive socket contact 44 (FIGS. 9A-9F) and are configured for slidable insertion into shield box 40, such that the socket contact 44 lies substantially parallel to a longitudinal axis of the shield box 40. In a preferred embodiment, first and second insulative members 70, 72 and spacer bars 74 are shaped and positioned relative to socket contact 44 and shield box 40 such that air is the dominant dielectric material surrounding socket contact 44, so as to adjust the effective dielectric constant of the termination device 12 and thereby adjust the characteristic impedance of the terminated cable assembly 12 closer to the desired target value, such as 50 ohm. In one embodiment, a spacer bar 74 of insulator 42 includes a laterally protruding latch element 80 that snaps into a mating opening 82 in shield box 40 to properly orient and maintain the insulator 42 within the shield box 40. As insulator 42 (containing socket contact 44) is inserted into shield box 40, the spacer bar 74 with latch element 80 deflects inwardly (toward contact 44) until engaging with mating opening 82 in the shield box 40. Beneficially, if insulator 42 is improperly assembled into shield box 40 (i.e., such that latch element 80 is not aligned or engaged with opening 82), the presence of latch element 80 will cause the shield box 40 to bulge such that the assembled termination device 12 will not fit through apertures 14 of organizer plate 10, thereby preventing the installation and use of an improperly assembled termination device 12.

In one embodiment, termination device 12 is configured for termination of an electrical cable 20, such that a signal conductor 90 of the electrical cable 20 is attached to socket contact 44 and ground shield 92 of the electrical cable 20 is attached to shield box 40 of the termination device 12 using conventional means, such as soldering. The type of electrical cable may be a single wire cable (e.g. single coaxial cable or single twin-axial cable). In one embodiment, prior to attaching socket contact 44 to the central conductor 90 of cable 20, ground shield 92 is stiffened by a solder dip process. After socket contact 44 is attached to central conductor 90, the socket contact 44 is slidably inserted into insulator 42. The prepared end of cable 20 and insulator 42 are configured such that the stiffened ground shield 92 bears against end 72 of insulator 42 prior to socket contact 44 being fully seated against end 70 of insulator 42. Thus, when insulator 42 (having socket contact 44 therein) is next slidably inserted into shield box 40, the stiffened ground shield 92 acts to push insulator 42 into shield box 40, and socket contact 40 is prevented from pushing against insulator 42 in the insertion direction. In this manner, socket contact 44 is prevented from being pushed back into cable 20 by reaction to force applied during insertion of insulator 42 into shield box 40, which may prevent proper connection of socket contact 44 with a header.

In one embodiment, first and second insulative members 70, 72 and spacer bars 74 of insulator 42 are configured to provide an open path between the area of shield box 40 to be soldered to ground shield 92 and the area under latch 54 of shield box 40, such that solder flux vapor may be vented during soldering.

Figure 21:
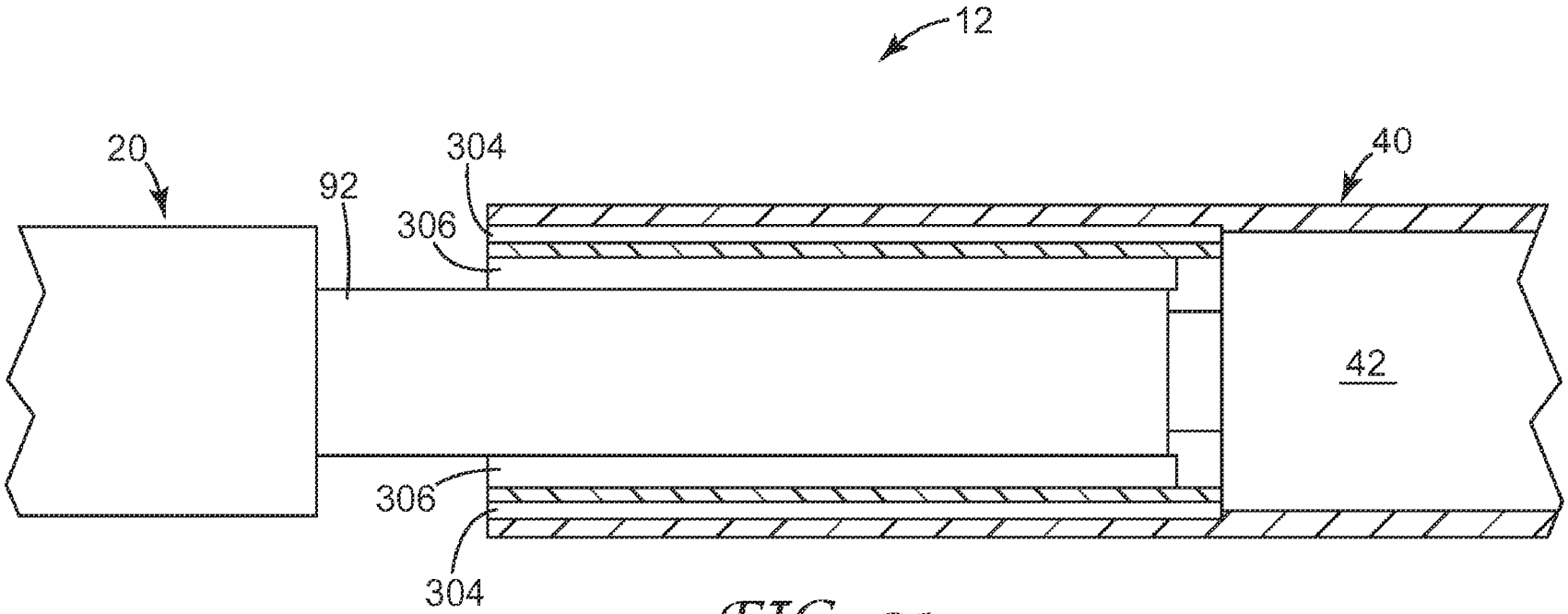
FIG. 21 is a cross-sectional illustration of a portion of a termination device having a reducing collar according to the invention.

As will be understood upon reading this disclosure, the size of shield boxes 40 must be sized to fit within apertures 14. However, in some implementations, the size of cable 20 to be terminated is smaller than the optimal cable size for a particular shield box 40 size. That is, in some instances, shield box 40 may be too large to reliably terminate a small gauge cable 20. Specifically, the gap between shield box 40 and ground shield 92 of cable 20 is too large to reliably bridge with solder to form a sufficiently large or strong solder fillet. Generally, solder fillets larger than about 0.005 inches are avoided because voids in the solder often occur, and fillets thicker than about 0.005 inches are much weaker, both of which could reduce the cable pullout withstanding force. In such circumstances, with reference to FIG. 21. a reducing collar 300 is provided between the interior of shield box 40 and ground shield 92 of electrical cable 20. Reducing collar 300 fills excess space between ground shield 92 and shield box 40 when small diameter cables are terminated, and assures that a strong and reliable solder fillet between ground shield 92 and shield box 40 can be achieved. In FIG. 21, reducing collar 300 abuts insulator 42 such that insulator 42 serves as an insertion depth stop for reducing collar 300. Reducing collar 300 thus fills an excessively large gap between shield box 40 and cable shield 92 to create smaller gaps 304, 306 into which molten solder can readily flow to form strong fillets. In one embodiment, reducing collar 300 is configured to draw molten solder into gaps 304, 306. In one embodiment, reducing collar has one or more channels (such as slots 302, 314, 324, 334 and 344 in FIGS. 22, 23, 24, 25 and 26, respectively) which act as capillaries to draw molten solder to all surfaces of the shield box 40, reducing collar 300, and cable ground shield 92 when molten solder is fed into only one or a few areas. In one embodiment, the thickness of the reducing collar 300 is selected to provide gaps 304, 306 for solder to fill that do not exceed about 0.005 inches. Bumps or other shapes can be formed into the inner and outer surfaces of reducing collar 300 to center collar 300 on the ground shield 92 of cable 20 and within the shield box 20. In one embodiment, reducing collar 300 includes solder barriers (e.g., nickel) on surfaces where solder is not required and solderable plating (which may be over the nickel) where solder fillets are desired. The solder barriers reduce the solder volume applied, and thereby reduce cost and improve consistency of soldering.

Figure 22:
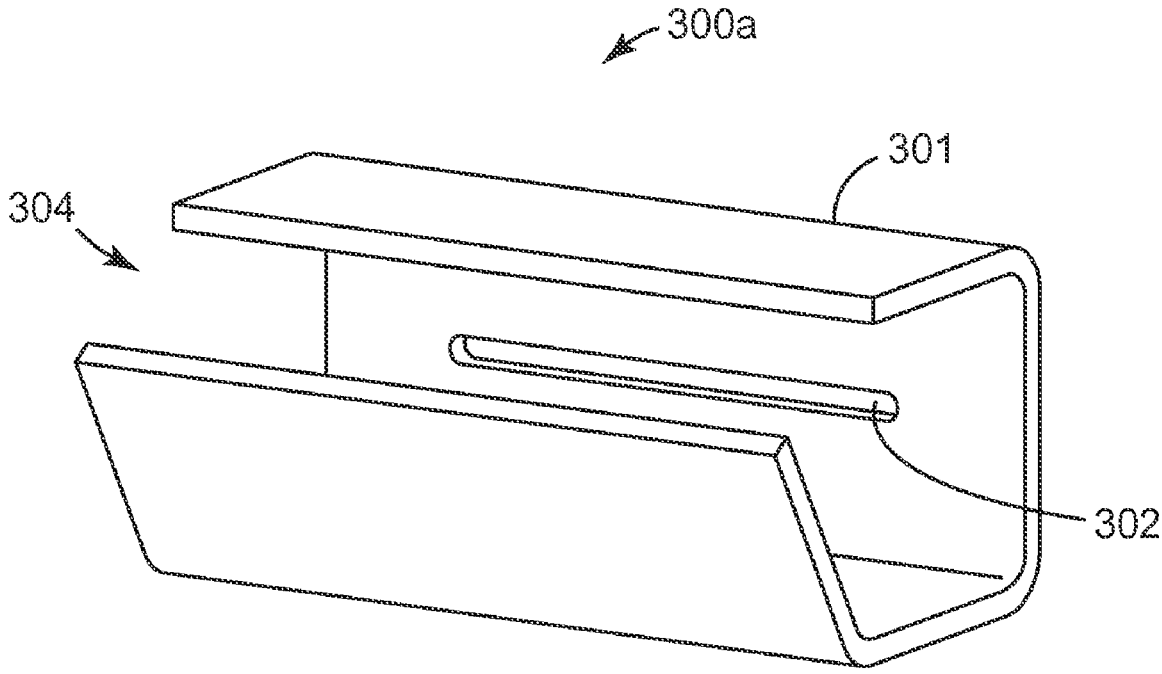
FIG. 22 is a perspective illustration of one embodiment of a reducing collar according to the invention.

Reducing collar 300 may assume several different embodiments and be produced in several different manners. In the embodiment of FIG. 22, reducing collar 300*a* comprises a body 301 formed from folded strip material and open at one side 304 to permit installation of the reducing collar 300*a* over ground shield 92 from the side. In one embodiment, reducing collar 300*a* is formed from a resilient material such that the open-sided reducing collar 300 remains in the shield box 40 once compressed and inserted into the shield box 40. Slots 302 act as capillaries to draw molten solder to all surfaces of the shield box 40, reducing collar 300*a*, and cable ground shield 92.

Figure 23:
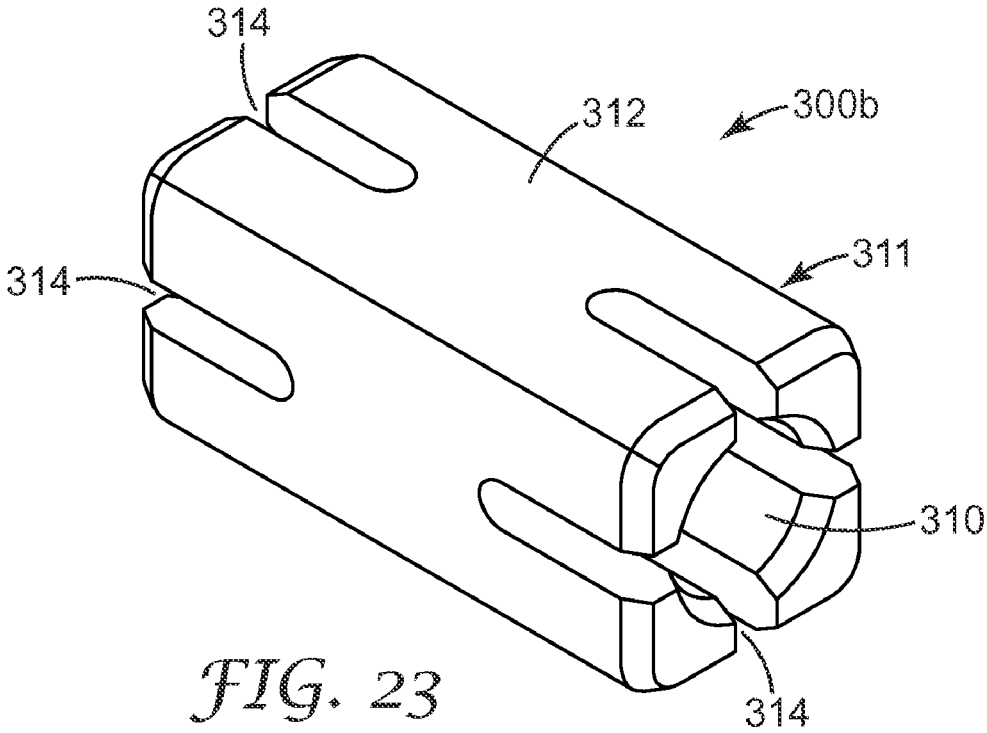
FIG. 23 is a perspective illustration of another embodiment of a reducing collar according to the invention.

In another embodiment, shown in FIG. 23, reducing collar 300*b* comprises a body 311 formed as a solid element without a seam and slipped over the end of cable 20 as one would apply a ferrule. Reducing collar 300*b* defines a generally cylindrical inner surface 310 that conforms to the generally cylindrical shape of ground shield 92, and further defines a generally rectangular outer surface 312 that conforms to the generally rectangular shape of the interior of shield box 40. The shapes of inner surface 310 and outer surface 312 aid in maintaining consistent dimensions of gaps 304, 306. Slots 314 act as capillaries to draw molten solder to all surfaces of the shield box 40, reducing collar 300*b*, and cable ground shield 92. Reducing collar 300*b* may be formed into the desired shape, for example, by casting, machining, metal injection molding (MIM), cold forming, etc.

Figure 24:
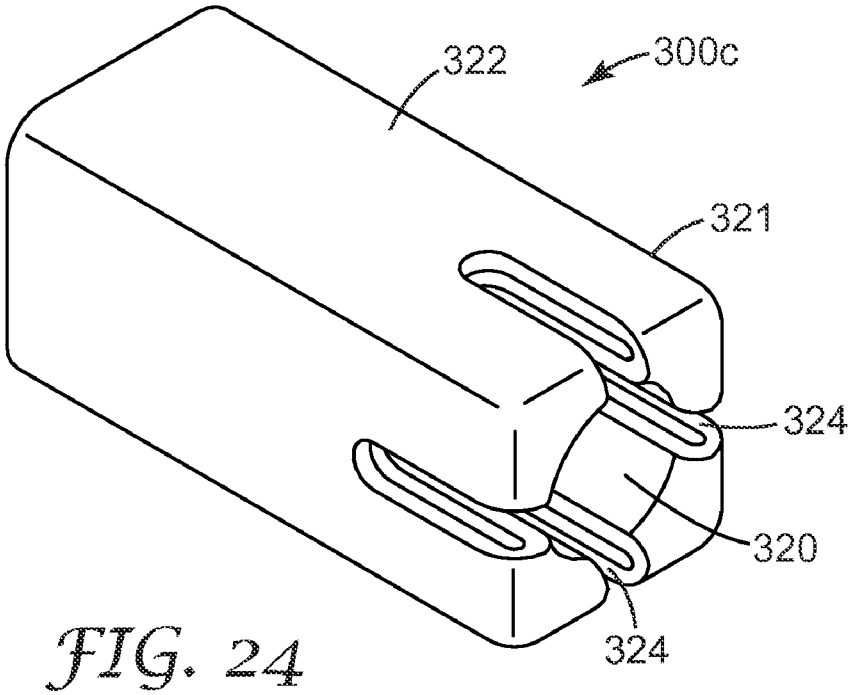
FIG. 24 is a perspective illustration of another embodiment of a reducing collar according to the invention.

In yet another embodiment, shown in FIG. 24, reducing collar 300*c* is a deep drawn tube without a seam. Body 321 of reducing collar 300*c* defines a generally cylindrical inner surface 320 that conforms to the generally cylindrical shape of ground shield 92, and further defines a generally rectangular outer surface 322 that conforms to the generally rectangular shape of the interior of shield box 40. The shapes of inner surface 320 and outer surface 322 aid in maintaining consistent dimensions of gaps 304, 306. Slots 324 act as capillaries to draw molten solder to all surfaces of the shield box 40, reducing collar 300*c*, and cable ground shield 92.

Figure 25:
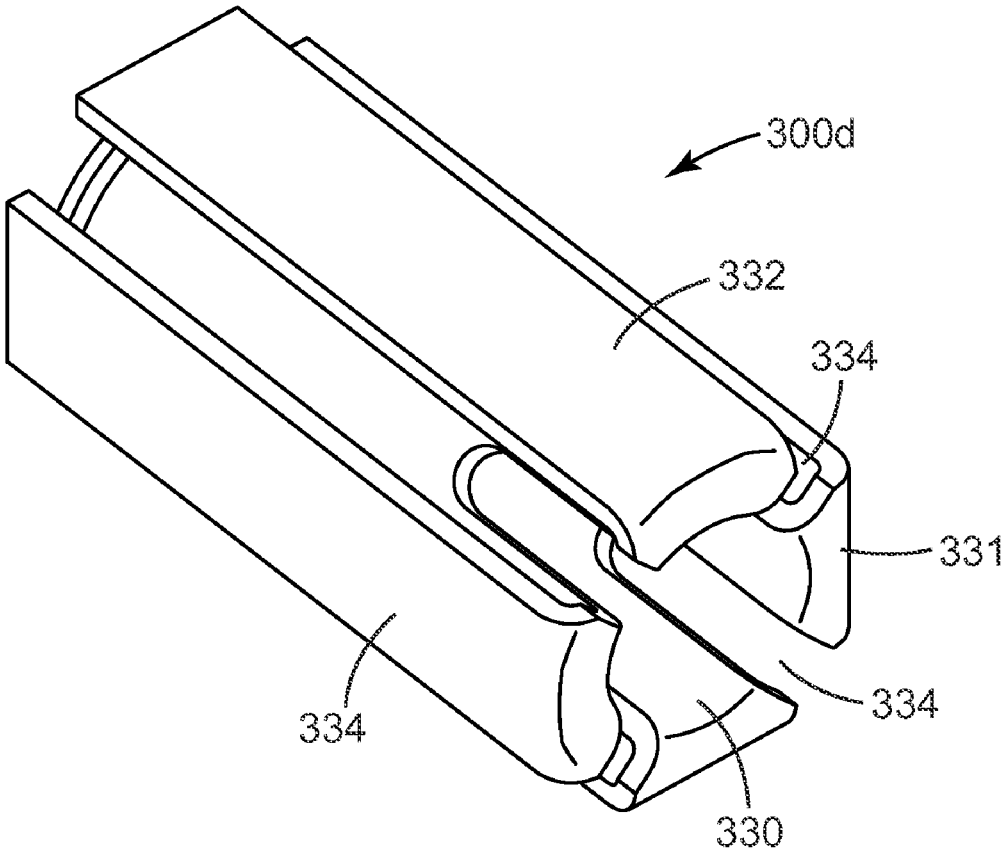
FIG. 25 is a perspective illustration of another embodiment of a reducing collar according to the invention.

In yet another embodiment, shown in FIG. 25, reducing collar 300*d* is a deep drawn tube having flat formed portions. The body 331 of reducing collar 300*d* includes generally cylindrical inner surface 330 defined by the deep drawn tube conforms to the generally cylindrical shape of ground shield 92, while the formed flat surfaces of outer surface 332 conform to the generally rectangular shape of the interior of shield box 40. The shapes of inner surface 330 and outer surface 332 aid in maintaining consistent dimensions of gaps 304, 306. Slots 334 act as capillaries to draw molten solder to all surfaces of the shield box 40, reducing collar 300*d*, and cable ground shield 92.

Figure 26:
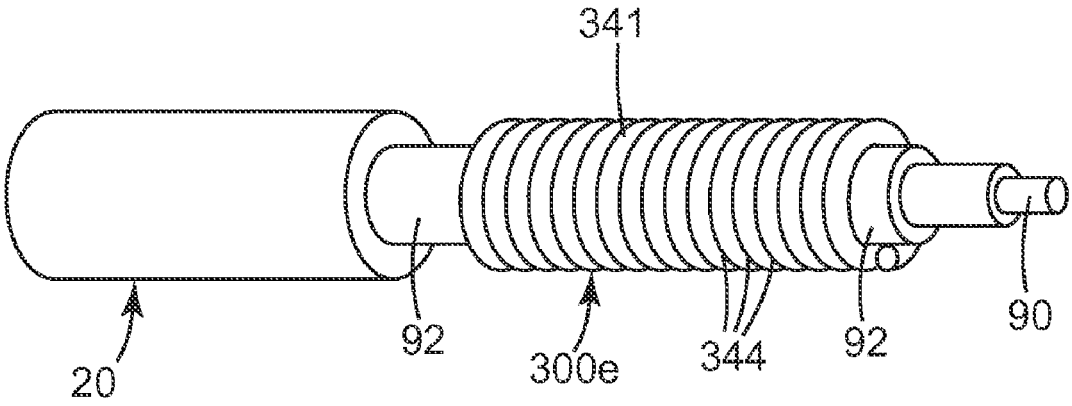
FIG. 26 is a perspective illustration of another embodiment of a reducing collar according to the invention.

In yet another embodiment, shown in FIG. 26, reducing collar 300*e* is a coiled spring-like body 341 having a small gap 344 between the coils. The gap 344 acts as a capillary to draw molten solder to all surfaces of the shield box 40, reducing collar 300*e*, and cable ground shield 92. Solder fillets between the coils, along ground shield 92, and along shield box 40 prevent the coiled reducing collar 300*e* from operating like an inductor in high speed signal applications.

Figure 10:
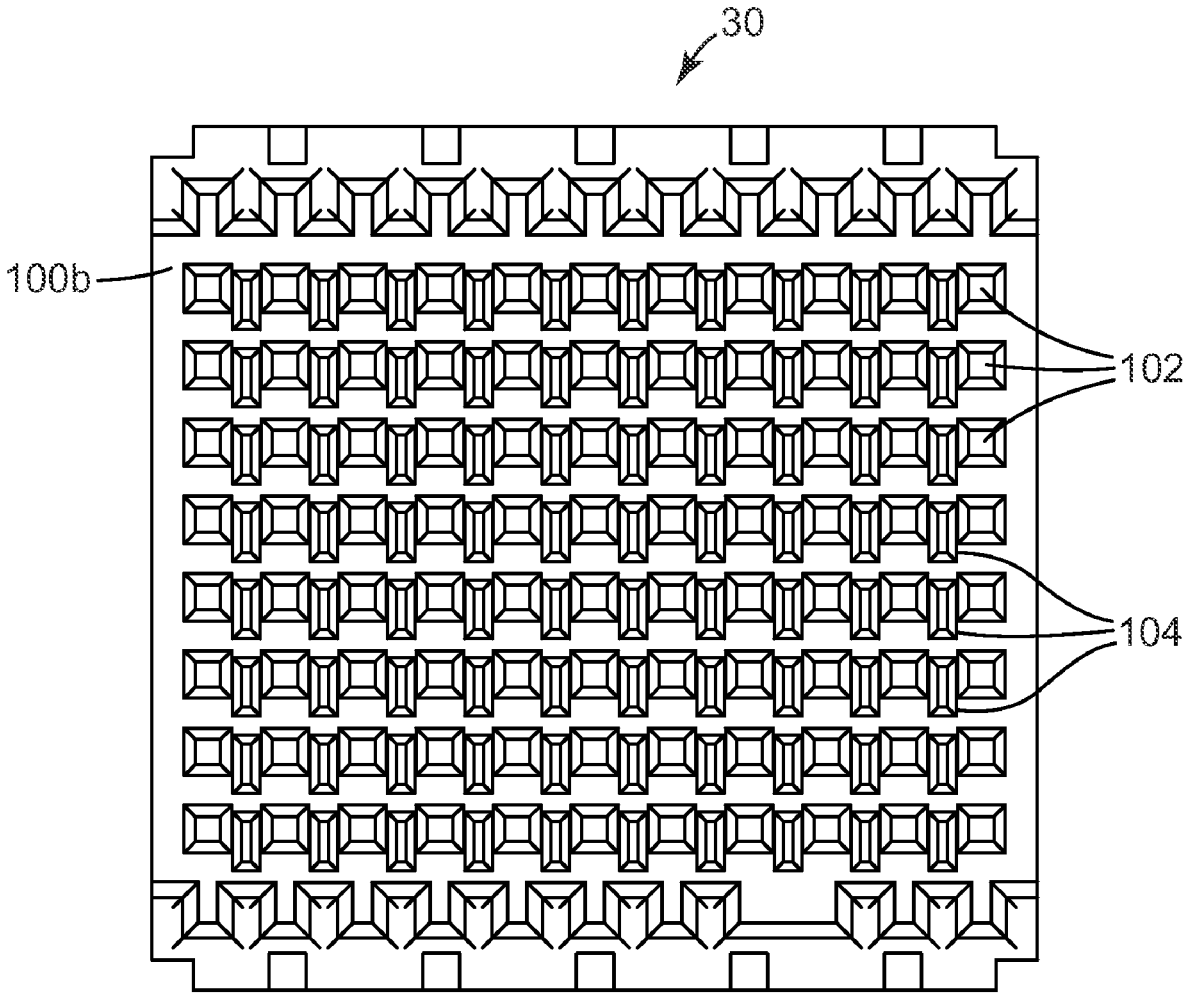
FIG. 10 is a plan view of the front wall of the adapter of FIGS. 2-4, showing an array of signal pin insertion apertures and ground blade insertion apertures.

For purposes of illustration, a single configuration of the carrier or adapter 30 is shown and described herein. However, it is to be understood that the primary features of the adapter 30 are generic as to the particular application and use of organizer plate 10. In particular, with reference to FIGS. 2-4, adapter 30 includes a generally planar front wall 100 having interior surface 100*a* and an exterior surface 100*b*. The front wall 100 is formed to include a plurality of pin insertion apertures 102 arranged in rows and columns. Between the pin insertion apertures 102 are blade insertion apertures 104, also arranged in rows and columns. (Best seen in FIG. 10). The adapter 30 is configured to receive the organizer plate 10 and termination devices 12 on the side of interior surface 100*a*, and is further configured on its external surface 100*b* to guide an array of signal pins 106 through the front ends 46 of the termination device shield boxes 40 to make electrical connection with the socket contacts 44 therein, and to guide an array of ground blades 108 into electrical contact with the ground contact beams 52 of the shield boxes 40.

Figure 11:
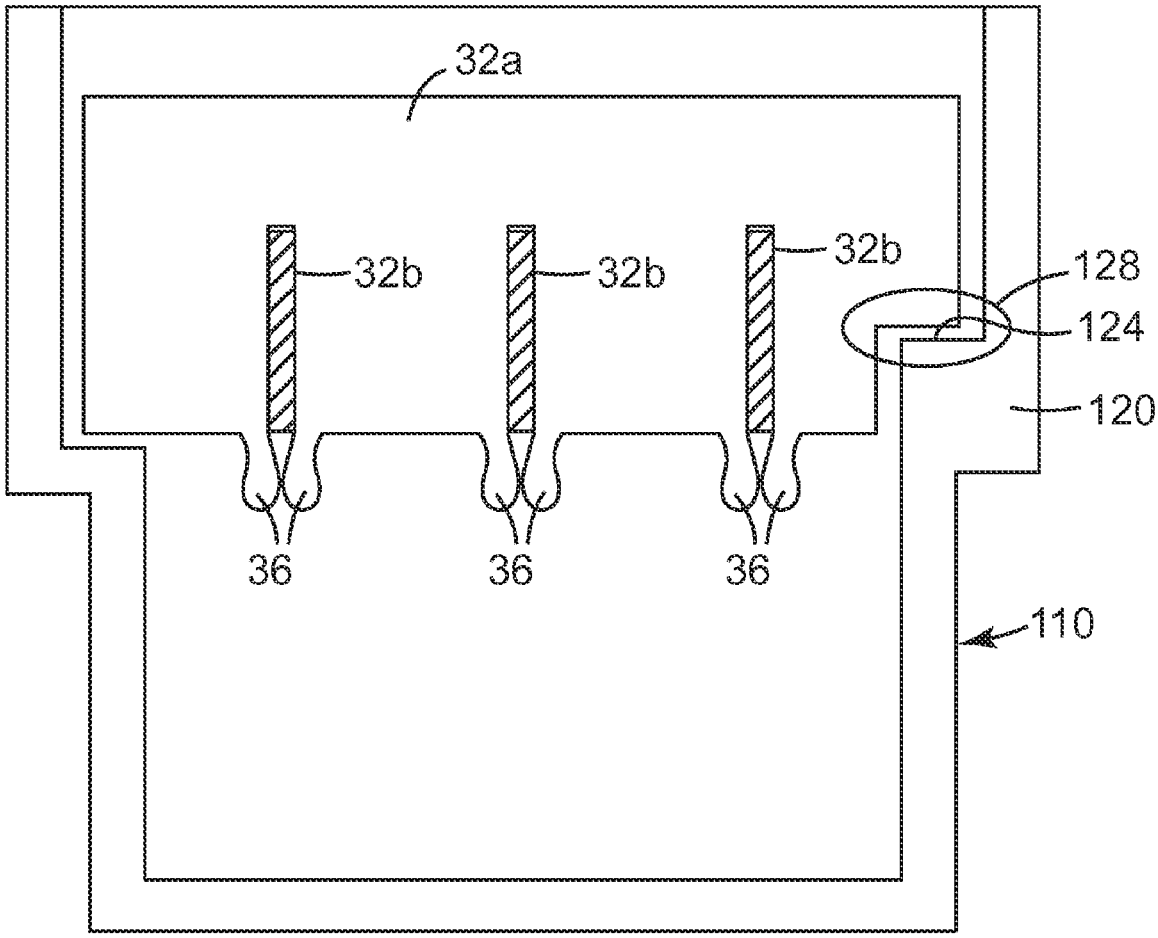
FIG. 11 a cross-sectional illustration of keying features configured to prevent incorrect installation of the organizer plate in the adaptor.

In the illustrated embodiment of FIGS. 2-4, the adapter 30 includes an electrically insulating housing 110 for receiving and securing organizer plate 10, and a load plate 112 for securing organizer plate 10 within housing 110. Housing 110 includes the generally planar front wall 100 described above and, as best seen in FIG. 4, further includes a plurality of recesses 114 on interior surface 100*a*, where each recess 114 is configured to receive the front end 46 of a termination device 12. Recesses 114 properly position the front end 46 of termination devices 12 with respect to pin insertion apertures 102 and blade insertion apertures 104. Housing 110 also includes pair of laterally-extending top and bottom side walls 120. End walls 122 are also provided. Side walls 120 are shaped to define inward facing laterally extending shoulders 124. Shoulders 124 include slots 126*a* for receiving ends of metal plates 32*a*. Similarly, end walls 122 include slots 126*b* for receiving ends of metal plates 32*b*. In one embodiment, the ends of metal plates 32*a*, 32*b* and the slots 126*a*, 126*b* in housing 110 are provided with keying features to prevent incorrect installation of organizer plate 10 in housing 110. Exemplary keying features include differently notched ends of plates 32*a* and/or 32*b* and correspondingly different slots 126*a*, and/or 126*b* in side walls 120 and end walls 122, as schematically illustrated in the circled portion 128 FIG. 11.

The shoulders 124 of side walls 120 are also configured to engage a mating interference shoulder 130 on load plate 112. Housing shoulder 124 and load plate interference shoulder 130 cooperate to properly position load plate 112 within housing 110 as load plate 112 is secured to housing 110. In addition, interference shoulder 130 of load plate 112 also functions to press against the ends of metal plates 32*a*, 32*b* to fully seat organizer plate 10 within the slots 126*a*, 126*b*, of housing 110. Housing 110 and load plate 112 are provided with latching features to maintain the housing 110 and load plate 112 in a mated condition. In the illustrated embodiment, side walls 120 include a plurality of rearwardly extending latch arms 140 configured to engage mating openings 142 in load plate 112. The housing 110 and load plate 112 are made by any conventional means, including molding and/or machining of an insulative polymeric material.

To assemble the electrical connector assembly, the termination devices 12 (terminating cables 20 in the illustrated embodiment) are inserted through apertures 14 of organizer plate 10 far enough that latch members 54 extend beyond the second (interior) surface 18 of organizer plate 10. The termination devices 12 are then slightly withdrawn such that latch members 54 engage the interior surface 18 of the organizer plate 10 and prevent further withdrawal of the termination devices 12. The organizer plate 10 and installed termination devices 12 are inserted into the housing 110 such that the front ends 46 of the termination devices 12 abut the interior surface 100*a* and are captured in recesses 114. Load plate 112 is secured to housing 110 to fully seat the organizer plate 10 and termination devices 12.

Figure 12:
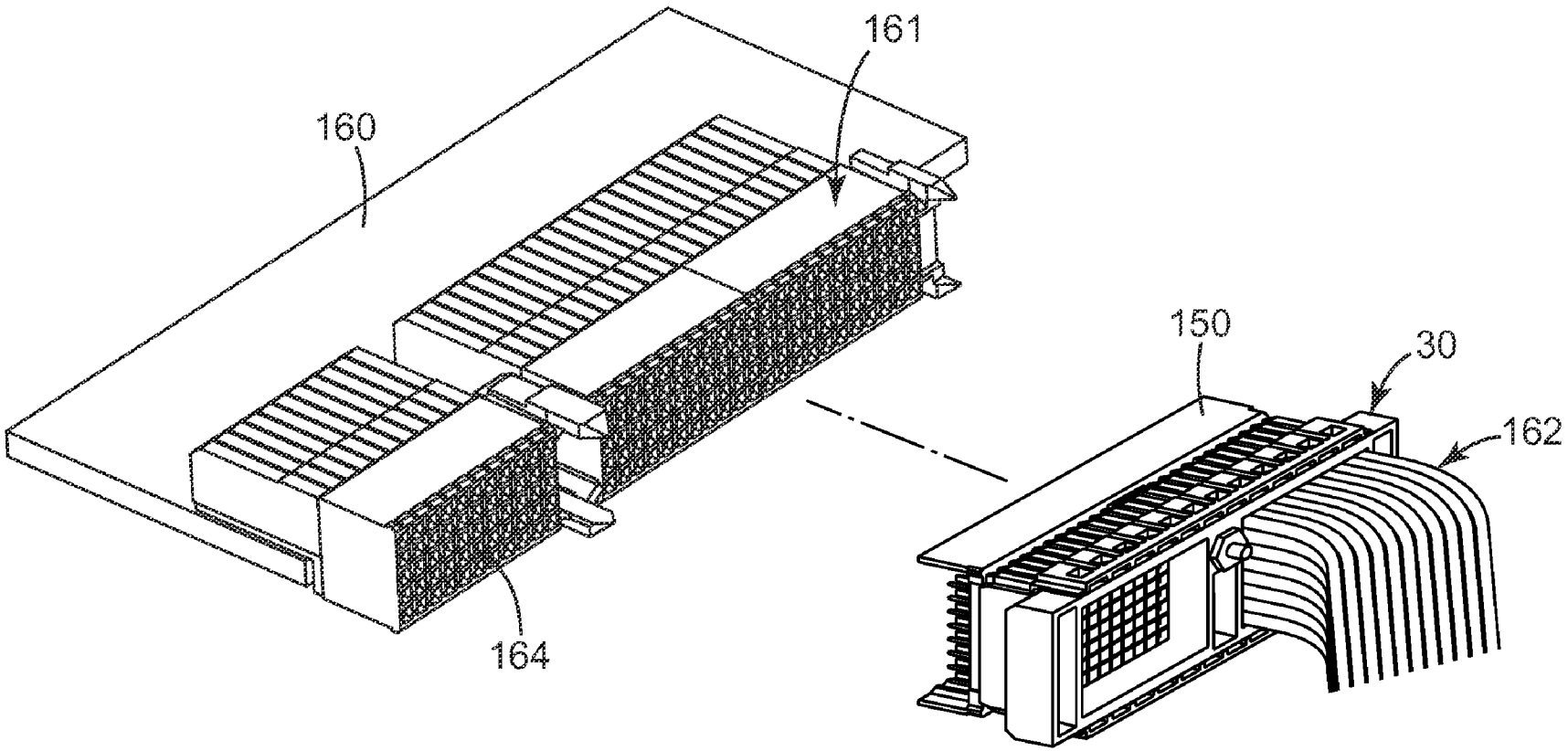
FIG. 12 is a perspective view of an exemplary electrical connector assembly positioned for connection to a socket connector on a printed circuit board.
Figure 15:
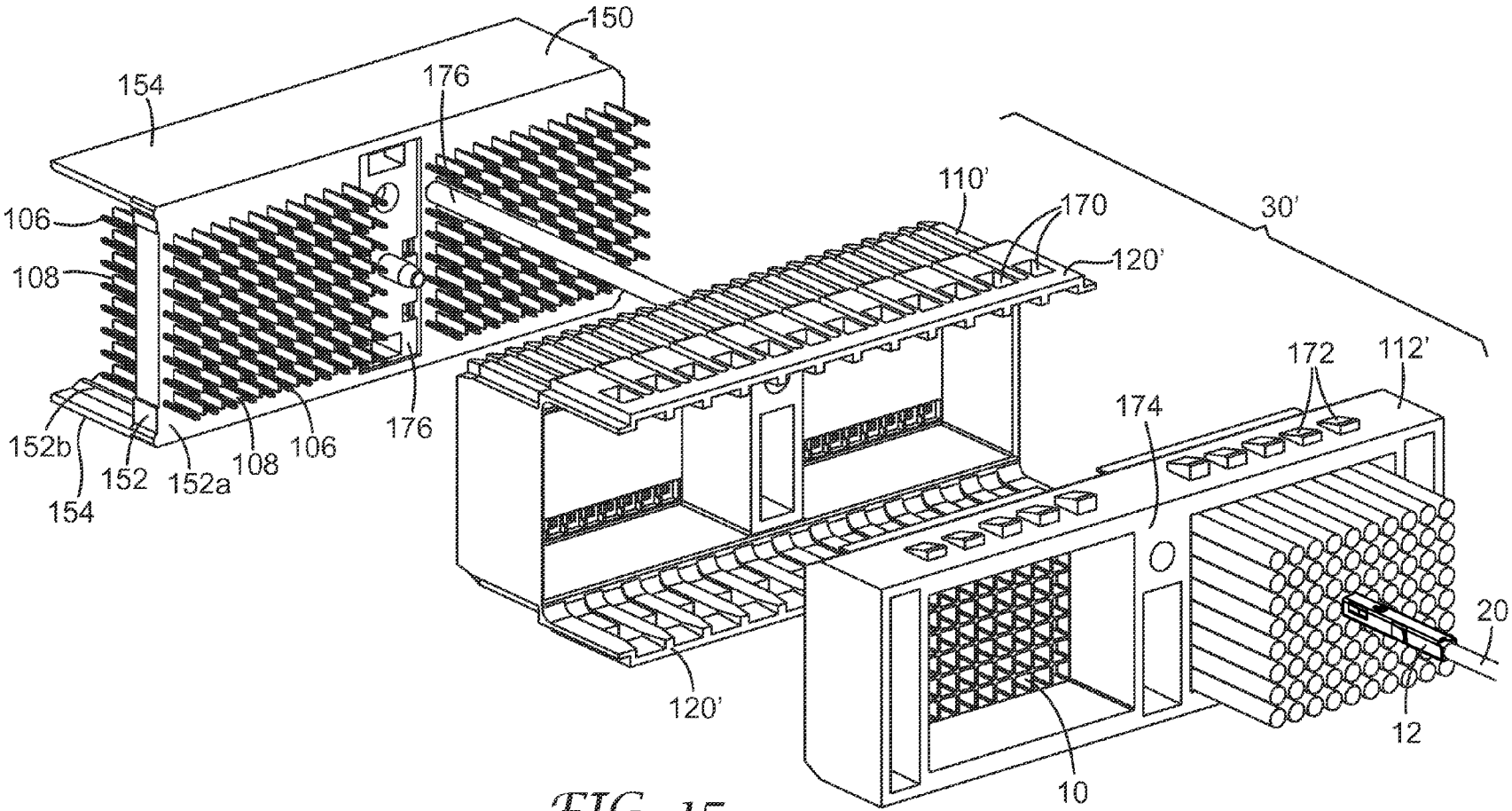
FIG. 15 is a perspective view showing another embodiment of the organizer plate, adapter and pin header.

Referring to FIGS. 12 and 15, an exemplary pin header 150 that can be used with the present invention is illustrated. The header 150 includes a vertical front wall 152 having interior surface 152*a* and exterior surface 152*b*, and laterally extending top and bottom walls 154. The vertical front wall 152 is formed to include a plurality of pin insertion windows for signal pins 106 and a plurality of blade insertion windows for ground blades 108, where the signal pins 106 and ground blades 108 extend through the wall 152. In use, the header 150 is mated with the adapter 30' such that exterior surface 152*b* of the pin header 150 is in contact with exterior surface 100*b* of the front wall 100 of housing 110' so that signal pins 106 and ground blades 108 slide through pin insertion apertures 102 and blade insertion apertures 104, respectively, to mate with socket contacts 44 and ground contact beams 52, respectively, of the termination devices 12. Another useful pin header that can be used in the present invention is disclosed in U.S. Pat. No. 6,146,202 (Ramey et al.), which is hereby incorporated by reference in its entirety.

Figure 13:
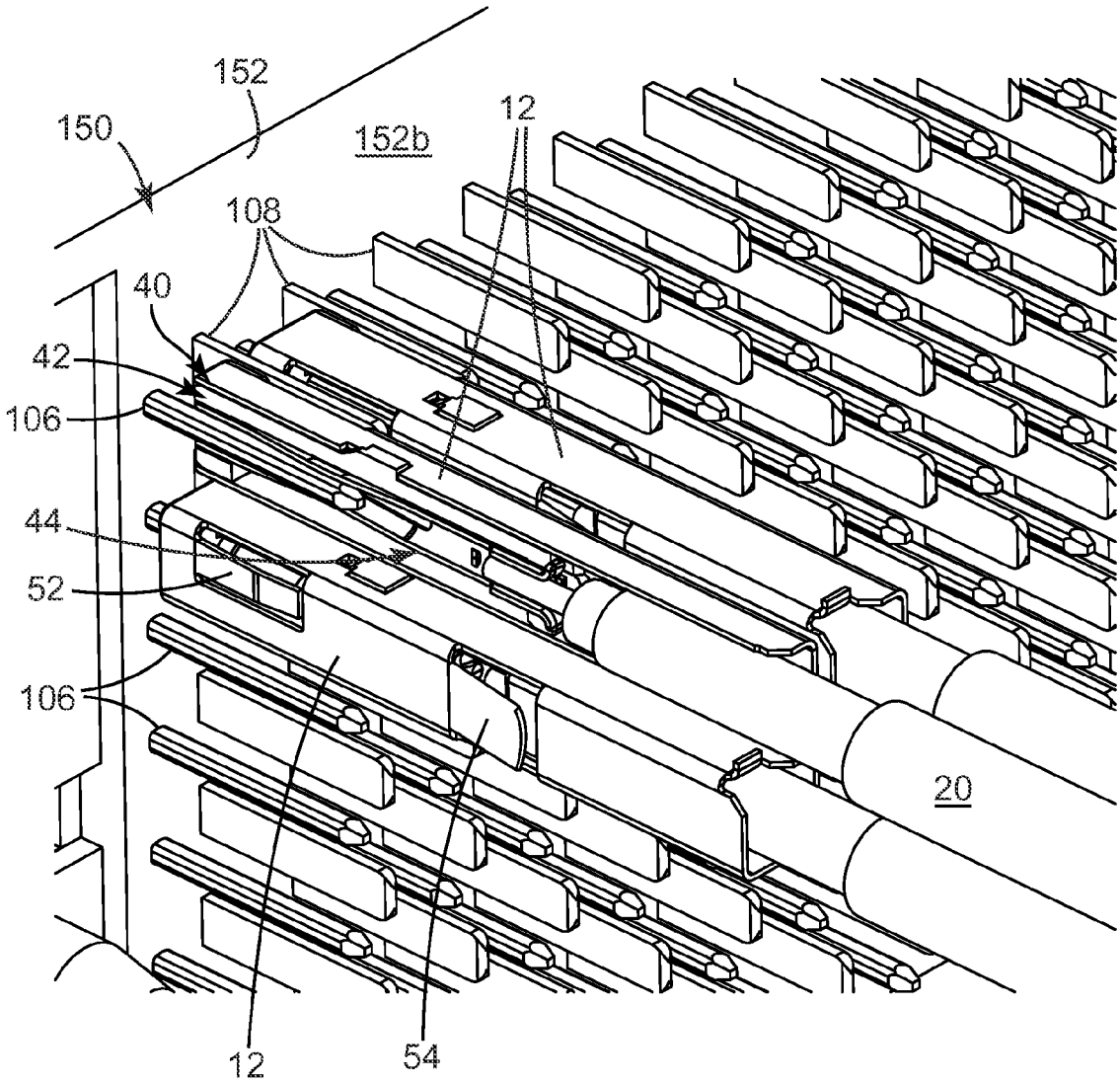
FIG. 13 is a perspective view showing a plurality of termination devices engaged with a pin header, with one termination device shown in cross-section.
Figure 14:
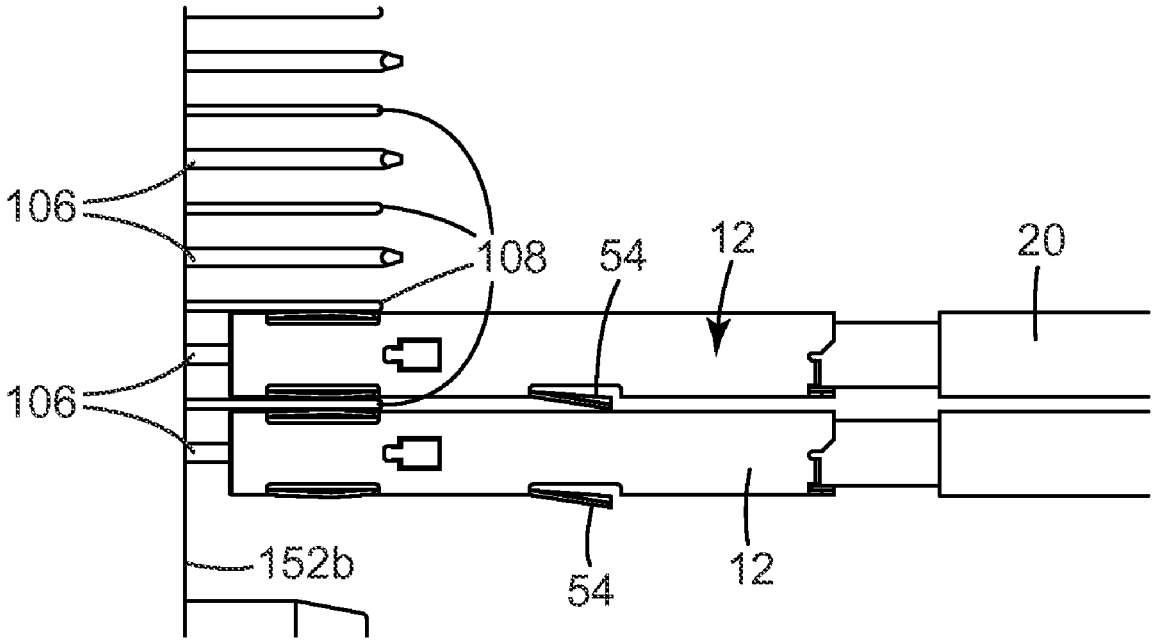
FIG. 14 is a top plan view showing termination devices of FIG. 13 engaged with a pin header.

Referring to FIGS. 13 and 14, termination devices 12 are shown engaged with signal pins 106 and ground blades 108 can be better understood. In FIG. 13, a portion of one termination device 12 and the adapter 30 is removed for clarity. As can be seen best from FIG. 14, in the illustrated embodiment, each ground blade 108 contacts the ground contact beams 52 of two adjacent termination devices 12.

Referring again to FIG. 12, the connector system is shown as used in conjunction with a printed circuit board (PCB) 160 having a socket connector 161 thereon. As shown, terminated cable assemblies 162 having a termination device 12 at one end are attached to one side of the carrier adapter 30 while pin header 150 is attached on the other side of the carrier adapter 30. The pin header 150 is then connected to socket connector 161 by inserting signal pins 106 and ground blades 108 into mating receptacles 164 of socket connector 161. The pin header 150 can be secured to the carrier adapter 30 by sufficiently high friction forces between the signal pins 106 and/or ground blades 108 and the termination devices 12. Alternatively or in addition to this friction force, the pin header 150 could be fastened to the carrier adapter 30 with additional mechanical fastening means.

Referring now to FIG. 15, in one embodiment according to the invention, the organizer plate 10 is integrally formed with load plate 112', such that organizer plate 10 and load plate 112' are simultaneously installed in housing 110'. In the embodiment of FIG. 15, housing 110' and load plate 112' (i.e., adaptor 30') are provided with latching features different than those shown and described with respect to FIGS. 2-4. In particular, side walls 120' of housing 110' are provided with openings 170 positioned and configured to receive protrusions 172 extending from load plate 112' as load plate 112' is inserted into housing 110'. Housing 110' and load plate 112' are also differently shaped from the adaptor 30 of FIGS. 2-4, in that housing 110' and load plate 112' include a dividing septum 174 configured to separate organizer plate 10 into two separate areas termination receiving areas. The septum 174 is further configured to cooperate with alignment and retention elements 176 extending from pin header 150', used to secure pin header 150' to adapter 30'.

Figure 16:
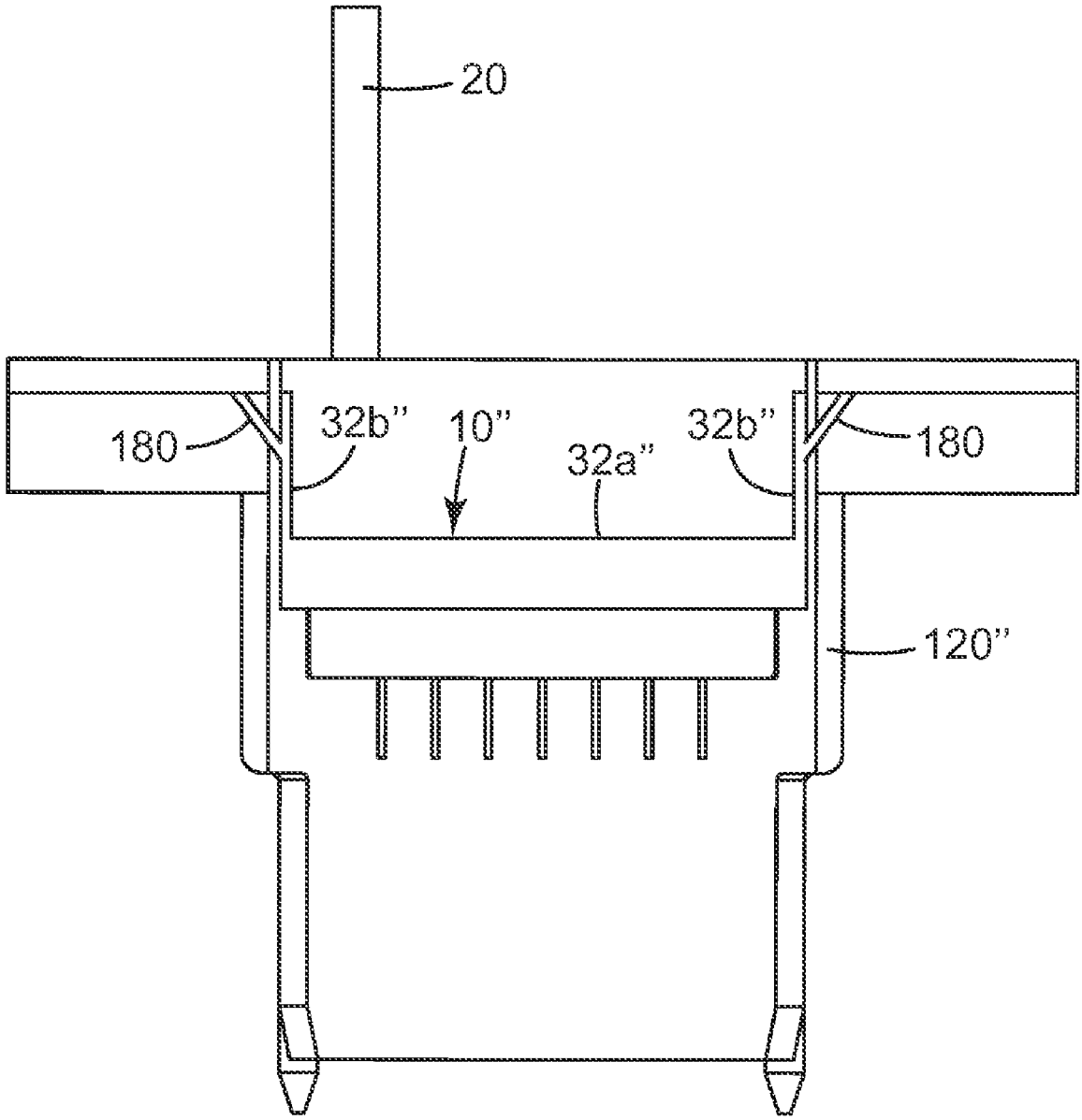
FIG. 16 is a schematic cross-sectional view showing an embodiment of the organizer plate having integral retention members.

Referring now to FIG. 16, another embodiment of an organizer plate and adapter are schematically illustrated. In the embodiment of FIG. 16, adapter 30" comprises a single element, rather than separate housing and load plate components (110, 110' and 112, 112', respectively) as described above. At least a portion of metal plates 32*a*", 32*b*" of organizer plate 10" are provided with integral retention members or latch arms 180 configured to engage the side walls 120" of adapter 30", and thereby prevent unintended withdrawal of organizer plate 10" from adapter 30". To remove organizer plate 10" from adapter 30", latch arms 180 are deflected out of engagement with side walls 120".

Figure 17A:
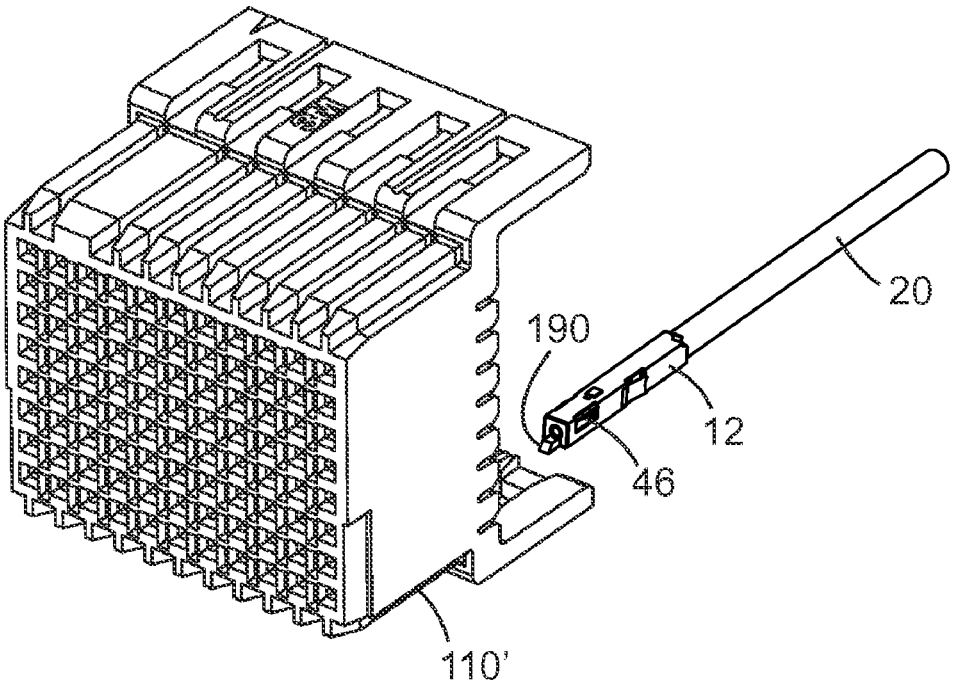
FIGS. 17A and 17B are perspective views showing another embodiment of the termination device having alternate keying features.
Figure 17B:
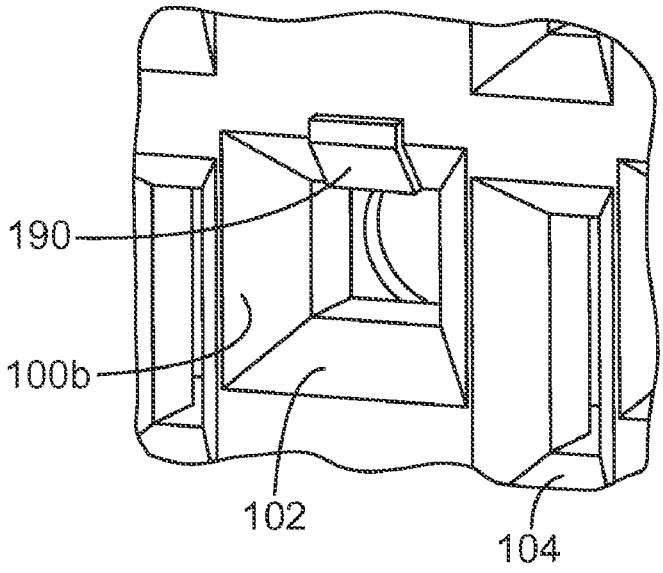

Referring now to FIGS. 17A and 17B, in one embodiment shield box 40 does not include the keying member (i.e., tab 60) as described above, and insulator 42 is instead formed to include a keying member to ensure the termination device 12 is inserted into the organizer plate 10 in the correct predetermined orientation. As best seen in FIG. 17A, the insulator 42 is provided with a protrusion 190 extending past the front end 46 of shield box 40. Protrusion 190 is configured to engage a mating recess in the front wall 100 of housing 110. As best seen in FIG. 17B, in one embodiment protrusion 190 is configured to form a portion of the signal pin insertion aperture 102 of the front wall 100.

Figure 18A:
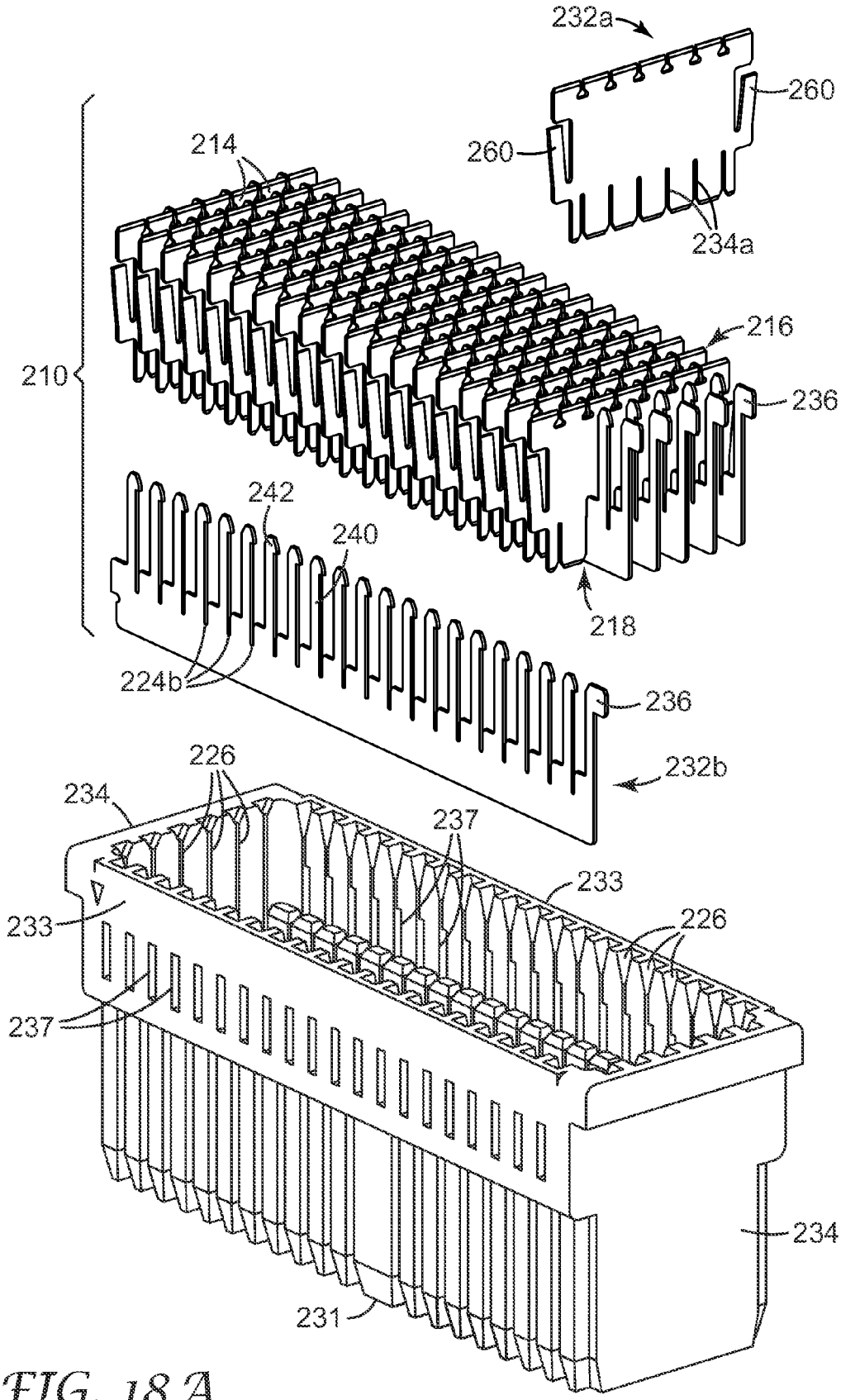
FIG. 18A is a perspective illustration showing another embodiment of an organizer plate and adaptor in an exploded condition according to the invention.
Figure 18B:
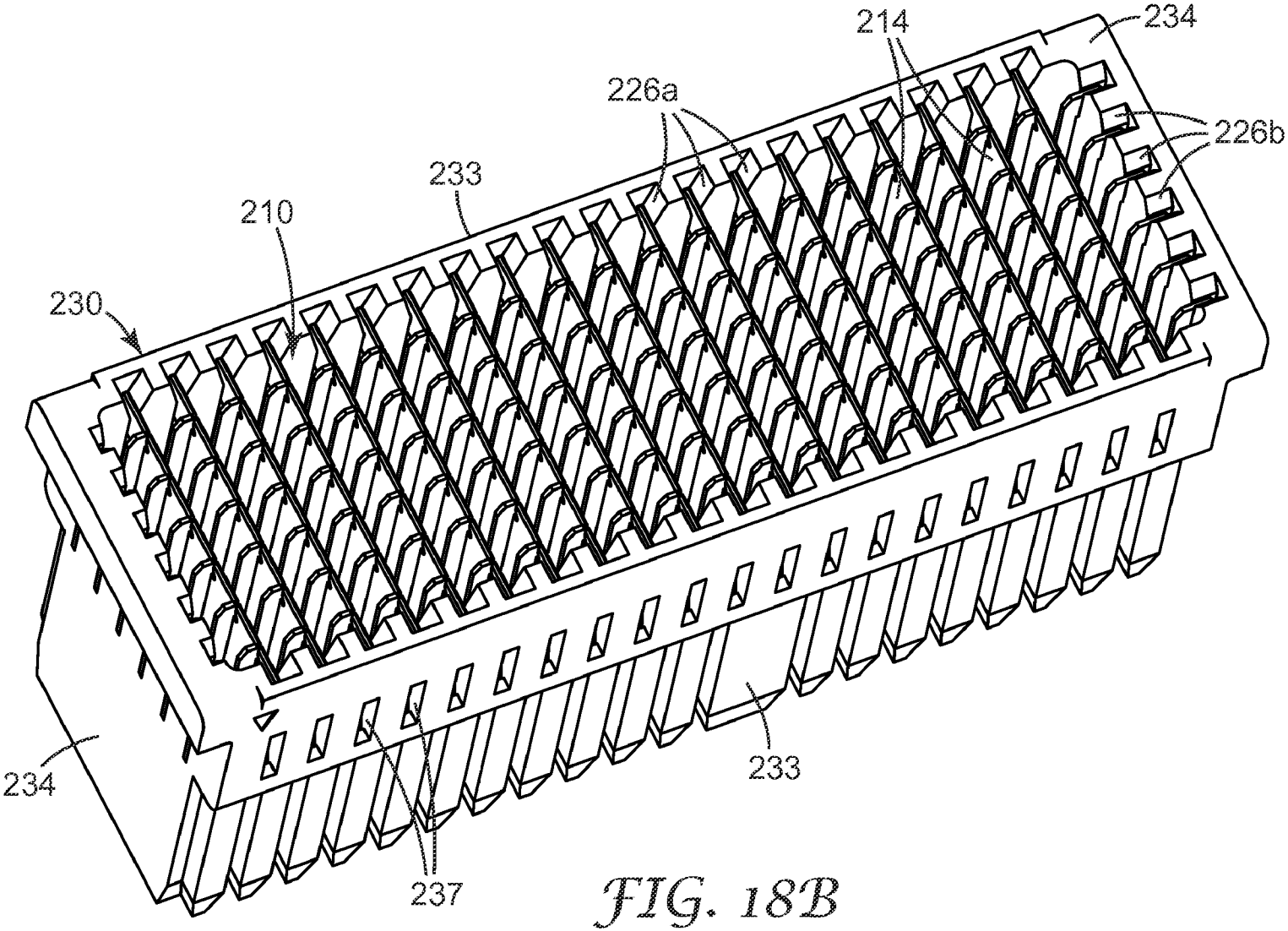
FIG. 18B is a perspective illustration showing the organizer plate and adaptor of FIG. 18A in an assembled condition according to the invention.

Referring now to FIGS. 18A and 18B, another embodiment of a retainer or organizer plate 210 is illustrated. As described above with respect to organizer plate 10, organizer plate 210 is configured to receive, secure and manage a plurality of termination devices 12. Organizer plate 210 includes a plurality of apertures 214 extending from a first side 216 to a second side 218 of the organizer plate 210. For clarity of illustration, termination devices 12 and associated electrical cables 20 are not shown in FIGS. 18A and 18B, although it is to be understood that organizer plate 210 is configured to accommodate termination devices 12 (such as those shown in FIGS. 1-4, 6-9F and 13-15) in each aperture 214.

Carrier or adaptor 230 is configured to receive the organizer plate 210. Adaptor 230 functions to adapt the organizer plate 210 to a particular application or use of organizer plate 210. In the embodiment illustrated herein, adapter 230 is configured to allow termination devices 12 in the organizer plate 210 to be mated with a pin header (such as pin header 150 as described with respect to FIGS. 13-15 above). As will be appreciated after reading the description herein, adaptor 230 is configured and functions substantially the same as adaptor 30 of FIGS. 2-4, but adaptor 230 does not require a load plate for securing organizer plate 210 within adaptor 230. For example, in one embodiment, adaptor 230 includes a front wall 231 configured substantially the same as front wall 100 described above with respect to adaptor 30, including recesses 114 configured to receive the front end 46 of a termination device 12 and properly position the front end 46 of termination devices 12. Adaptor 230 also includes pair of laterally-extending side walls 233, and end walls 234 are also provided. Side walls 233 include slots 226*a* for receiving ends of metal plates 232*a*. Similarly, end walls 234 include slots 226*b* for receiving ends of metal plates 232*b*.

Figure 19:
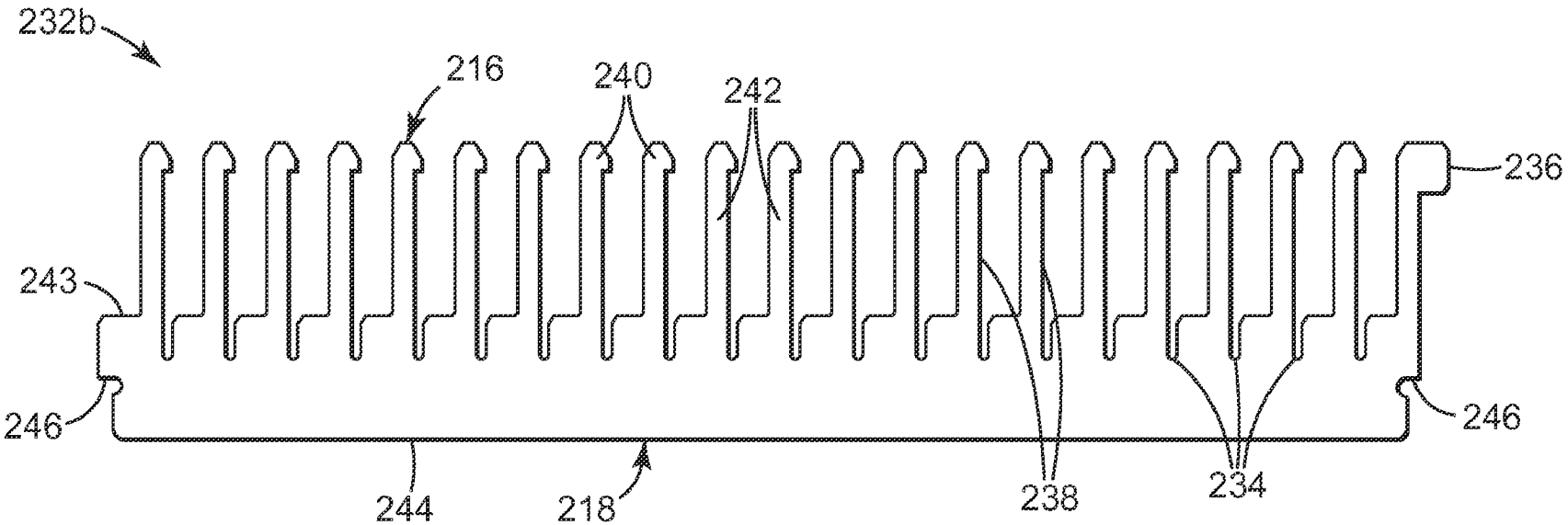
FIG. 19 is a plan illustration of a row organizer of the organizer plate of FIGS. 18A and 18B.
Figure 20:
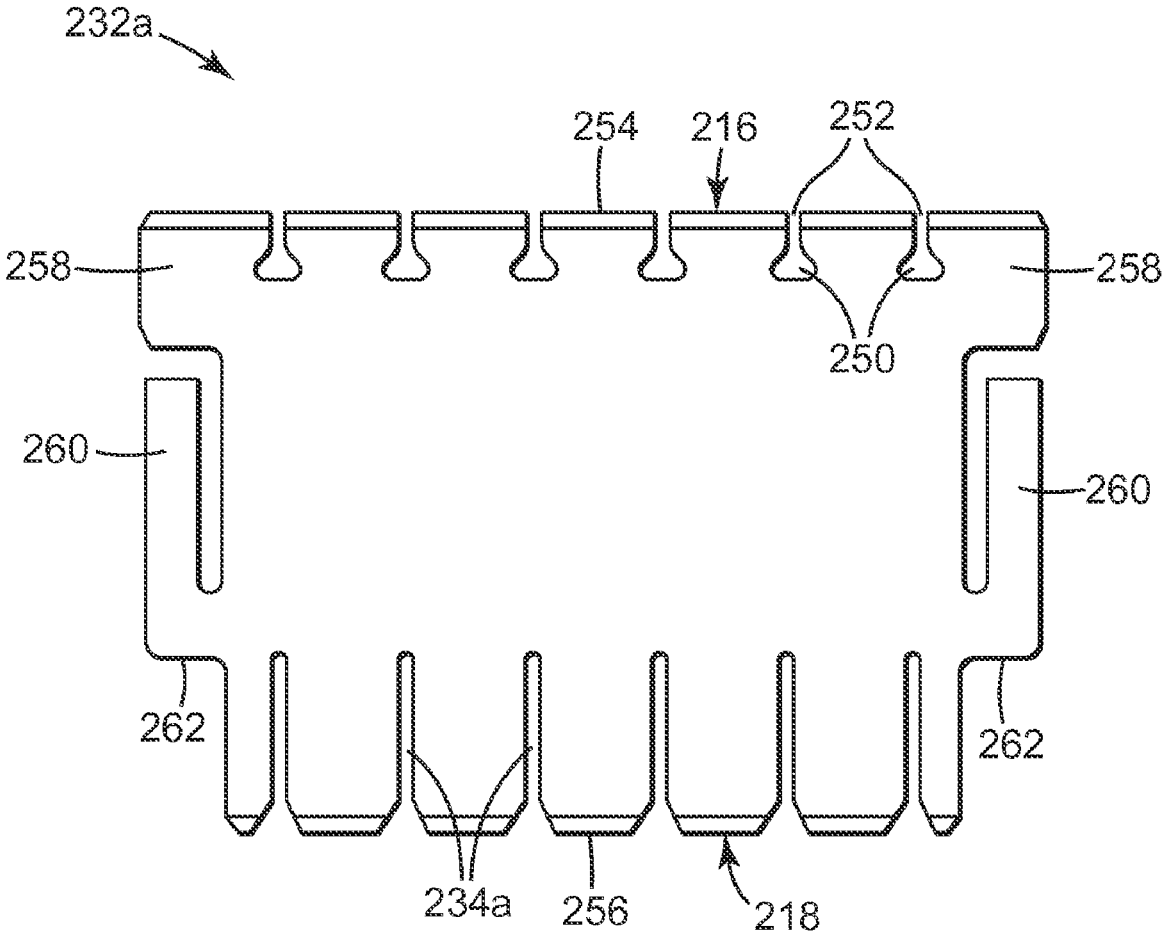
FIG. 20 is a plan illustration of a column organizer of the organizer plate of FIGS. 18A and 18B.

In the illustrated embodiment, organizer plate 210 is formed of a plurality of transversely positioned and interconnected substantially planar metal plates 232*a*, 232*b* (collectively plates 232) having interlocking channels or slots 234*a*, 234*b* (collectively slots 234), respectively, such that when assembled the plurality of metal plates 232*a*, 232*b* define the plurality of apertures 214. Features of plates 232 are best seen in FIGS. 19 and 20. Each aperture 214, bounded by four walls defined by plates 232*a*, 232*b*, guides a termination device 12 into alignment with alignment features on the front wall 231 of the adaptor 230 to assure registration with mating face geometry. Optionally, outside row and column apertures (i.e., those apertures 214 at the periphery of organizer plate 210) can be bounded by three walls defined by plates 232 and one wall defined by the adaptor 230.

Referring to FIG. 19, a single plate 232*b* (also referred to herein as a "row organizer plate" or simply "row organizer") is illustrated. Row organizer plate 232*b* defines a top edge 243 and a bottom edge 244. Alignment arms 240 extend from top edge 243 away from bottom edge 244 and are configured to aid insertion of termination devices 12 into organizer plate apertures 214. In particular, alignment arms 240 help an assembler align termination devices 12 with apertures 214 opening during the initial stage of termination device 12 insertion. The end of each arm 240 defines a latch 242 configured to lock into intermeshed plates 232*a*, as is described in further detail below. Latches 242 keep assembly together if plates 232*a*, 232*b* are assembled outside of adaptor 230. As will be understood after reading this disclosure, latches 242 also hold their respective alignment arms 240 in position, and prevent inadvertent bending of alignment arms 240 during handling and insertion of termination devices 12 into apertures 214.

Bottom edge 244 of row organizer plate 232*b* engages the latch arms 54 of termination devices 12 as they are inserted into apertures 214, thereby retaining termination devices 12 in their respective apertures 214 and maintaining the position of termination devices 12 relative to the adaptor 230 mating face. As understood with additional reference to FIGS. 6 through 71, when termination device 12 is inserted into an aperture 214 of organizer plate 210, latch member 54 is resiliently deflected inwardly (toward the interior of shield box 40) until clearing bottom edge 244 of row organizer plate 232*b*, at which time latch member 54 returns to its original position to engage the bottom edge 244 of row organizer plate 244 and resist pull-out of the termination device 12.

Row organizer plate 232*b* further includes an insertion stops 246 on opposite ends thereof, the insertion stops 246 configured to position organizer plate 232*b* in adaptor 230 such that latches 242 of alignment arms 240 fully engage with reciprocal features of organizer plate 232*a* (described in further detail below), and also such that latch member 54 of termination device 12 engages bottom edge 244 before stopping against the front wall 300 of adaptor 230.

Polarizing key 236 prevents row organizer plate 232*b* from being inserted incorrectly into adaptor 230, as adaptor 230 is reciprocally shaped to accept polarizing key 236 in only one orientation. Row organizer plate 232*b* further includes a plurality of polarizing channels 238 that are configured to accept a keying member of the termination device 12. As understood with additional reference to FIGS. 6-7F, shield box 40 of termination device 12 includes a keying member, in the form of tab 60, laterally extending from the back end 48 of the shield box 40. When termination device 12 is inserted into organizer plate 210, tab 60 fits into channels 238 of organizer plate 210 to ensure the termination device 12 is inserted into the organizer plate aperture 214 in the correct predetermined orientation. If termination device 12 is not properly oriented within the organizer plate aperture 214, the termination device 12 cannot be fully inserted, such that latch member 54 cannot engage second side 218 of organizer plate 210.

Referring to FIG. 20, a single plate 232*a* (also referred to herein as a "column organizer plate" or simply "column organizer") is illustrated. Column organizer plate 232*a* defines a top edge 254 and a bottom edge 256, and includes a plurality of guide slots 250 for capturing latches 242 of alignment arms 240 as column organizer plates 232*a* are installed over row organizer plates 232*b* (FIG. 18A). In particular, guide slots 250 are positioned adjacent top edge 254 and shaped to capture latches 242 of misaligned alignment arms 240 of row organizer 232*b* and guide the arms 240 into corresponding registration channels 252 during assembly of row and column organizers 232*b*, 232*a*. Registration channels 252 hold alignment arms 240 rigidly in place to resist deflection during handling and insertion of termination devices 12. In one embodiment, top and bottom edges 254, 256, respectively, of column organizer plate 232*a* are beveled to prevent conductive plating on shield box 40 from being abraded during insertion of termination devices 12.

Column organizer plate 232*a* further includes latch arms 260 extending out of the plane defined by plate 232*a* (best seen in FIG. 18A) configured to engage adapter 230 and thereby lock column organizer plate 232*a* into adaptor 230. In this manner, back-out of column and row organizer plates 232*a*, 232*b*, respectively, is prevented when termination devices 12 are subjected to push-out forces during header mating and pullout forces applied to terminated cables 20. In one embodiment, latch arms 260 on opposite edges of column organizer plate 232*a* extend toward opposite faces of plate 232*a*, such that column organizer plate 232*a* may be inserted in either of two orientations. Specifically, as best seen in FIG. 18A, in one embodiment, windows or recesses 237 which engage latch arms 260 are offset toward opposite faces of slots 226*a*, such that the oppositely offset windows 237 cooperate with oppositely extending latch arms 260, thereby permitting column organizer plates 232*a* to be rotated 180° and still successfully latch into adaptor 230.

Side tabs 258 are configured to align organizer plates 232*a* in adaptor 230, and protect latch arms 260 from damage by providing a pushing surface during insertion into adaptor 220. In one embodiment, side tabs 258 are further configured prevent the side walls 233 of adaptor 230 from being crushed inwardly, such as when being grasped during unmating from a header (not shown). In this manner, at least column organizer plates 232*a* provide structural support and rigidity to adaptor 230. Finally, insertion stops 262 limit travel of column organizer plate 232*a* in adaptor 230 during assembly to prevent distortion of column and row organizer plates 232*a*, 232*b*, respectively.

Column and row organizer plates 232*a*, 232*b*, respectively, can be assembled to form organizer plate 210 in a fixture outside of the adaptor 230 and then inserted into adaptor 230 as an assembled unit. In one implementation, an assembled organizer plate 210 is used without adaptor 230, such as by direct attachment to a printed circuit. In this implementation, when directly open to airflow, the metal plates 232*a*, 232*b* forming organizer plate 210 also act as an effective heat sink, thereby allowing increased current to be carried through the termination devices 12. In one embodiment, organizer plate 10, 210 (alone or within adaptor 30, 230) may be electrically connected to an electrical ground to provide shielding or to augment or replace shield box 40.

Column and row organizer plates 232*a*, 232*b*, respectively, can alternately be individually placed directly into the adaptor 230. Using this assembly method, row organizer plates 232*b* are first inserted into adaptor 230. Column organizer plates 232*a* are then inserted into the adaptor 230 and at the same time, interlock with and retain the row organizer plates 232*b* within adaptor 230.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An electrical connector assembly comprising:

an assembly of individual organizer plates having a plurality apertures extending therethrough; and a plurality of termination devices, wherein each termination device comprises:

an electrically conductive outer shield box having a front end and a back end, the shield box having at least one outwardly extending ground contact element disposed on a side surface thereof, and a latch member extending therefrom;

an insulator disposed within the shield box; and a socket contact supported within and electrically isolated from the shield box by the insulator, the socket contact configured for making electrical connections through the front end and back end of the shield box;

wherein when the individual termination devices are inserted into corresponding apertures of the assembly of individual organizer plates, the latch member engages a surface of the assembly of individual organizer plates to resist withdrawal of the termination device from the corresponding aperture.

2. The electrical connector assembly of claim 1, further comprising an adaptor having a first side and a second side, wherein the first side of the adaptor is configured to receive the assembly of individual organizer plate and termination devices, and the second side of the adaptor is configured to guide an array of signal pins through the front ends of the termination device shield boxes to make electrical connection with the socket contacts therein, and to guide an array of ground blades into electrical contact with the ground contact elements of the shield boxes.

3. The electrical connector assembly of claim 1, wherein the plurality of termination devices each terminate an electrical cable, and wherein the electrical cable is separable from the termination device by application of a first pulling force, and wherein the latch member of the shield box is configured to allow withdrawal of the termination device from the corresponding aperture upon application of a second pulling force less than the first pulling force.

4. The electrical connector assembly of claim 1, wherein the assembly of individual organizer plates is constructed of one of a polymeric material, a metal, and a metal frame overmolded with a polymeric material.

5. The electrical connector assembly of claim 1, wherein the assembly of individual organizer plates comprises:

a plurality of planar row organizer plates, each row organizer plate defining a top edge and a bottom edge, a plurality of first slots extending from the top edge toward the bottom edge, and a plurality of alignment arms extending from the top edge away from the bottom edge; and a plurality of planar column organizer plates transversely positioned with respect to the plurality of row organizer plates, each column organizer plate defining a top edge and a bottom edge, a plurality of second slots extending from the bottom edge toward the top edge, and a plurality of registration channels extending from the top edge toward the bottom edge;

wherein the first slots of the row organizer plates interlock with the second slots of the column organizer plates, and wherein the alignment arms of the row organizer plates are retained by the registration channels of the column organizer plates.

6. The electrical connector assembly of claim 5, wherein the plurality of row organizer plates further define polarizing channels configured to accept keying members of the termination devices, the polarizing channels and keying members cooperating to position the termination devices in predetermined orientations within the apertures.

7. The electrical connector assembly of claim 6, wherein the latch members of the termination devices will not engage the assembly of individual organizer plates unless the termination devices are in the predetermined orientation.

8. The electrical connector assembly of claim 5, further comprising an adaptor configured to receive the plurality of row organizer plates and column organized plates and to guide signal pins into electrical contact with the socket contacts, wherein at least a portion of the plurality of row organizer plates and column organized plates are configured to provide structural support to the adaptor.

9. The electrical connector assembly of claim 8, further comprising a pin header including an array of signal pins configured for engagement with the adaptor.

10. The electrical connector assembly of claim 8, wherein the plurality of row organizer plates each further define a polarizing key, and wherein polarizing keys allow insertion of the row organizer plates into the adaptor in only one predetermined orientation.

11. The electrical connector assembly of claim 8, wherein the column organizer plates include latch arms configured to engage the adaptor and resist removal of the row and column organizer plates.

12. The electrical connector assembly of claim 11, wherein the column organizer plates are configured for insertion into the adaptor in more than one orientation.

13. The electrical connector assembly of claim 1, wherein the assembly of individual organizer plates is constructed of an electrically conductive material.

14. The electrical connector assembly of claim 13, wherein the assembly of individual organizer plates is electrically connected to an electrical ground.

15. An organizer for use in an electrical connector assembly, the organizer comprising:

a plurality of planar row organizer plates, each row organizer plate defining a top edge and a bottom edge, a plurality of first slots extending from the top edge toward the bottom edge, and a plurality of alignment arms extending from the top edge away from the bottom edge; and a plurality of planar column organizer plates transversely positioned with respect to the plurality of row organizer plates, each column organizer plate defining a top edge and a bottom edge, a plurality of second slots extending from the bottom edge toward the top edge, and a plurality of registration channels extending from the top edge toward the bottom edge;

wherein the first slots of the row organizer plates interlock with the second slots of the column organizer plates, and wherein the alignment arms of the row organizer plates are retained by the registration channels of the column organizer plates.

* * * * *

UNITED STATES PATENT AND TRADEMARK OFFICE

CERTIFICATE OF CORRECTION

PATENT NO. : 7,553,187 B2
APPLICATION NO. : 11/627258
DATED : June 30, 2009
INVENTOR(S) : Steven Feldman It is certified that error appears in the above-identified patent and that said Letters Patent is hereby corrected as shown below:

Column 1,
Line 3, delete "To" and insert --TO-- therefor.

Column 2,
Line 24, delete "defined" and insert --define-- therefor.

Column 4,
Line 3, after "FIG. 1)" insert --.--.

Column 6,
Line 23, delete "21." and insert --21,-- therefor.

Column 13,
Line 7, in Claim 2, delete "plate" and insert --plates-- therefor.

Signed and Sealed this

Seventeenth Day of November, 2009

David J. Kappos

David J. Kappos
*Director of the United States Patent and Trademark Office*